US006990748B2

(12) United States Patent
Magoon et al.

(10) Patent No.: US 6,990,748 B2
(45) Date of Patent: Jan. 31, 2006

(54) METHOD AND APPARATUS FOR EVAPORATING LIQUID FROM A PRODUCT

(75) Inventors: Richard E. Magoon, Tacoma, WA (US); Alan D. Whitefoot, University Place, WA (US)

(73) Assignee: Karin M. Bolland, Tacoma, WA (US)

( * ) Notice: Subject to any disclaimer, the term of this patent is extended or adjusted under 35 U.S.C. 154(b) by 0 days.

(21) Appl. No.: 10/940,393

(22) Filed: Sep. 13, 2004

(65) Prior Publication Data

US 2005/0115099 A1 Jun. 2, 2005

Related U.S. Application Data

(60) Provisional application No. 60/502,393, filed on Sep. 12, 2003.

(51) Int. Cl.
*F26B 11/18* (2006.01)

(52) U.S. Cl. ..... 34/197; 34/237

(58) Field of Classification Search ..... 34/197, 34/237; 165/104.21, 115

See application file for complete search history.

(56) References Cited

U.S. PATENT DOCUMENTS

| | | | | |
|---|---|---|---|---|
| 3,504,738 | A | 4/1970 | Mcguffey | |
| 3,913,667 | A | 10/1975 | Maylan et al. | |
| 4,216,820 | A | 8/1980 | Andrew | |
| 4,393,923 | A | 7/1983 | Press | |
| 4,435,339 | A | 3/1984 | Kragh | |
| 4,631,837 | A | 12/1986 | Magoon | |
| 5,176,187 | A | 1/1993 | Grant | |
| 5,535,791 | A | 7/1996 | Lisec | |
| 5,634,269 | A | 6/1997 | Lowenstein | |
| 5,927,383 | A | 7/1999 | Ramm-Schmidt et al. | |
| 6,047,484 | A * | 4/2000 | Bolland et al. | 34/197 |
| 6,068,730 | A | 5/2000 | Ramm-Schmidt et al. | |
| 6,241,010 | B1 | 6/2001 | Ramm-Schmidt et al. | |
| 6,293,121 | B1 * | 9/2001 | Labrador | 62/304 |
| 6,497,107 | B2 | 12/2002 | Maisotsenko et al. | |

* cited by examiner

*Primary Examiner*—Stephen Gravini
(74) *Attorney, Agent, or Firm*—R. Reams Goodloe, Jr.

(57) ABSTRACT

A replaceable heat transfer module. The replaceable heat transfer module has an inlet floodbox with fluid distribution passageways, an outlet manifold with fluid collection passageways, and extending in a fluid tight relationship between the fluid distribution passageways and the fluid collection passageways, a thin, elongate evaporator envelope. The evaporator envelope has a lower flexible planar sheet and an upper flexible planar sheet, each having inner surfaces located in a back-to-back spaced apart relationship. The evaporator envelope has an upper end wherein the lower and upper flexible planar sheets are fluidly sealed to the inlet floodbox, and a lower end wherein the lower and upper planar sheets are fluidly sealed to said outlet manifold. Mylar brand polyester is used for construction of the evaporator envelope. A marginal area on each side extends lengthwise transversely beyond the inlet floodbox and the outlet manifold to provide sloping sidewalls for containment of a working product.

87 Claims, 13 Drawing Sheets

METHOD AND APPARATUS FOR EVAPORATING LIQUID FROM A PRODUCT

RELATED PATENT APPLICATIONS

This patent application claims priority from prior U.S. Provisional Patent Application Ser. No. 60/502,393 filed on Sep. 12, 2003, entitled METHOD AND APPARATUS FOR EVAPORATING LIQUID FROM A PRODUCT, the disclosure of which is incorporated herein in its entirety by this reference.

COPYRIGHT RIGHTS IN THE DRAWING

A portion of the disclosure of this patent document contains material that is subject to copyright protection. The applicant has no objection to the facsimile reproduction by anyone of the patent document or the patent disclosure, as it appears in the Patent and Trademark Office patent file or records, but otherwise reserves all copyright rights whatsoever.

1. Technical Field

This invention relates to heat transfer apparatus, especially as may be employed for concentrating and drying operations. Such apparatus is particularly well suited to sanitary applications, such as processing and packaging of foods.

2. Background

Methods and apparatus for the transfer of heat through a thin, infrared transparent film between a flowable product such as sludge, slurry, extract, juice, or other like product, and a heated or chilled liquid, have been taught in previous patents used in earlier development of our equipment, namely U.S. Pat. No. 4,631,837, issued Dec. 30, 1986 for a Method and Apparatus for Drying Fruit Pulp and the Like, and U.S. Pat. No. 6,047,484, issued Apr. 11, 2000, for a Method and Apparatus for Evaporating Liquid from a Product, and the disclosures of each of these U.S. patents is incorporated herein in their entirety by this reference. However, the challenge of providing a clean, sanitary environment for evaporation of liquid from a product, or for chilling a product, especially as practiced using a thin flexible film material, has continued to require development of new apparatus and methods, especially to take advantage of such apparatus when applied to food preparation. And concurrently, the need for sanitary systems that can be easily cleaned to a high level of purity, i.e., freedom from biological contamination, has continued to be of utmost importance to food processors. Thus, the ability to provide an improved, easily cleanable and easily maintainable evaporation or chilling apparatus for sanitary, cleanable applications, such as drying of fruits or other foods, has become increasingly important. This is especially true at locations which are making foods such as fruit leathers from a pulp or fruit juice mass, which, after drying, must remain viable for long storage periods. Also, in order to pass governmental inspections in most, if not all locales, easily cleaned sanitary equipment is mandatory. Thus, there has been an increasing demand for high performance drying and evaporation systems, including for designs such as those taught in the prior art patents that were just noted above, but that demand has been coupled with a further requirement to provide an easily replaceable heat transfer element useful when drying a food product. Consequently, this disclosure provides description of a novel heat transfer apparatus, and of the novel equipment in which such heat transfer apparatus can be employed.

BRIEF DESCRIPTION OF THE DRAWING

In order to enable the reader to attain a more complete appreciation of the invention, and of the novel features and the advantages thereof, attention is directed to the following detailed description when considered in connection with the accompanying figures of the drawing, wherein.

Figure 17:
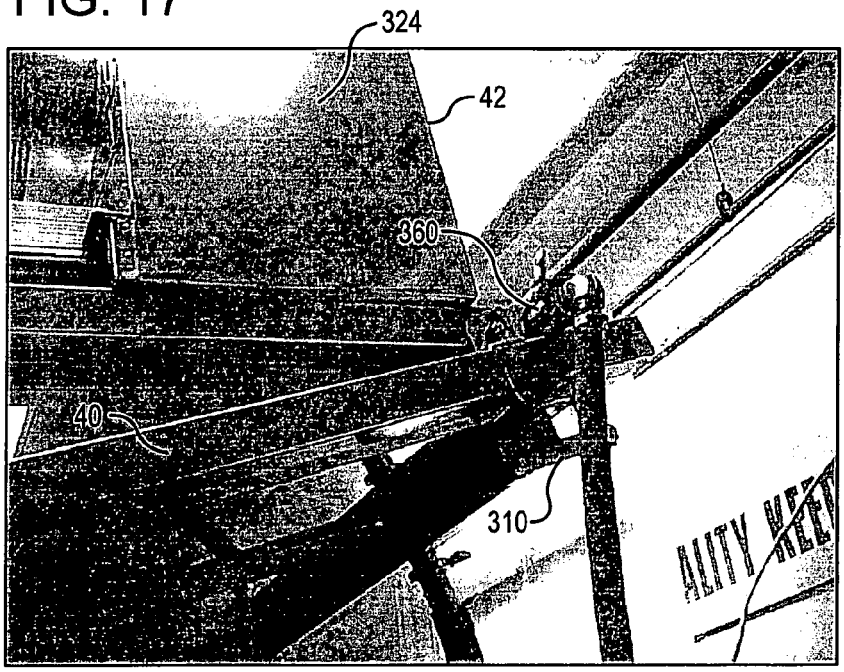

One embodiment for a pivot joint between the support tray and the retractable hood is illustrated in FIG. 17, which also shows the working product supply line, through which working product is sent to the working product distributor.

Figure 18:
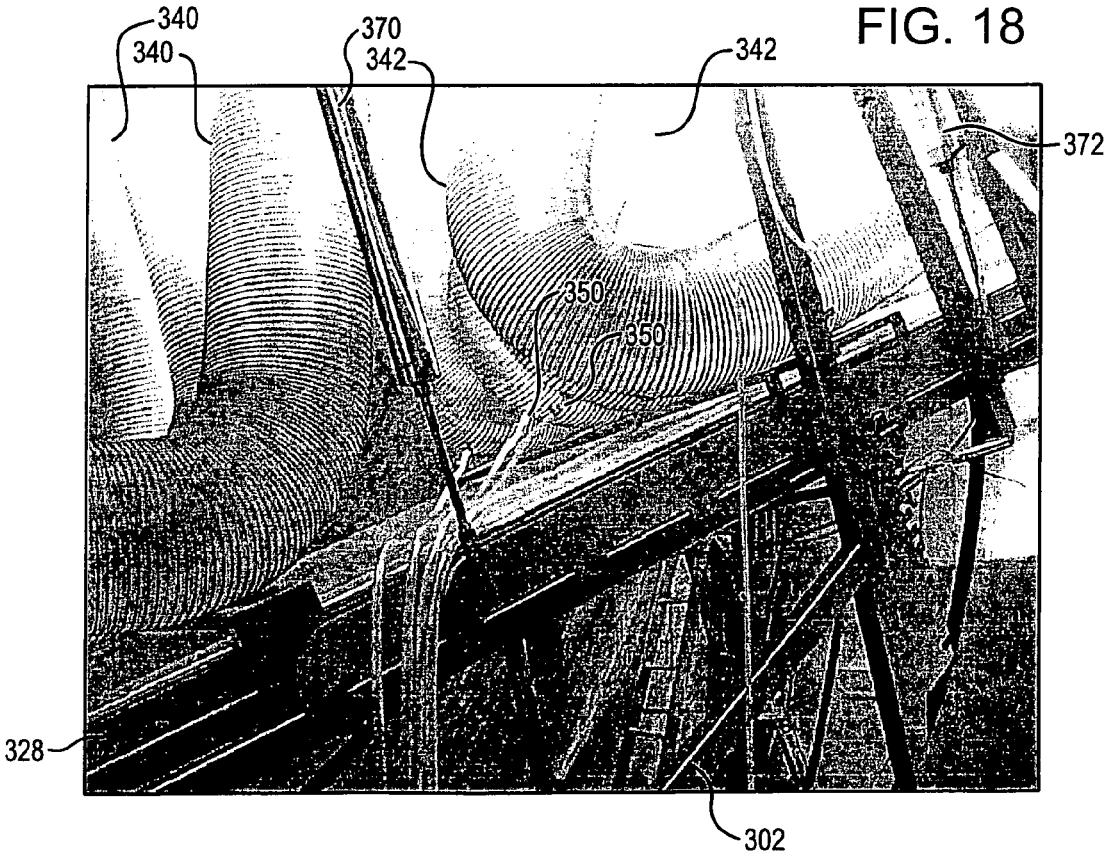

In FIG. 18, the closed, working position of the retractable hood is illustrated, showing how the sweep air plenum portion of the retractable hood is brought into close mating relationship with the lateral edges of the support tray, so that sweep air is substantially prevented from escape during countercurrent movement of sweep air from the inlet air plenum to the outlet air plenum of the retractable hood.

Figure 19:
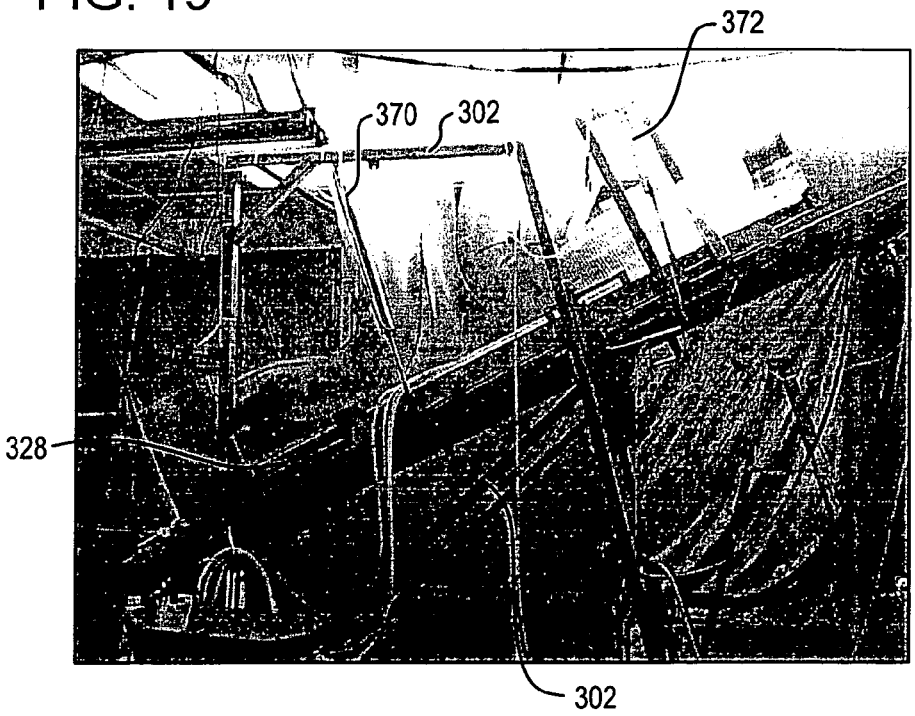

FIG. 19 is similar to FIG. 18, also showing the retractable hood in the closed, working position, but now showing the inlet air ducts which provide air to the inlet air plenum, the sweep air plenum wherein sweep air is brought into contact with the working product, the outlet plenum from which the outlet air ducts emerge, and a plurality of drain lines from which condensate or entrained moisture is collected from the outlet air ducts.

Figure 20:
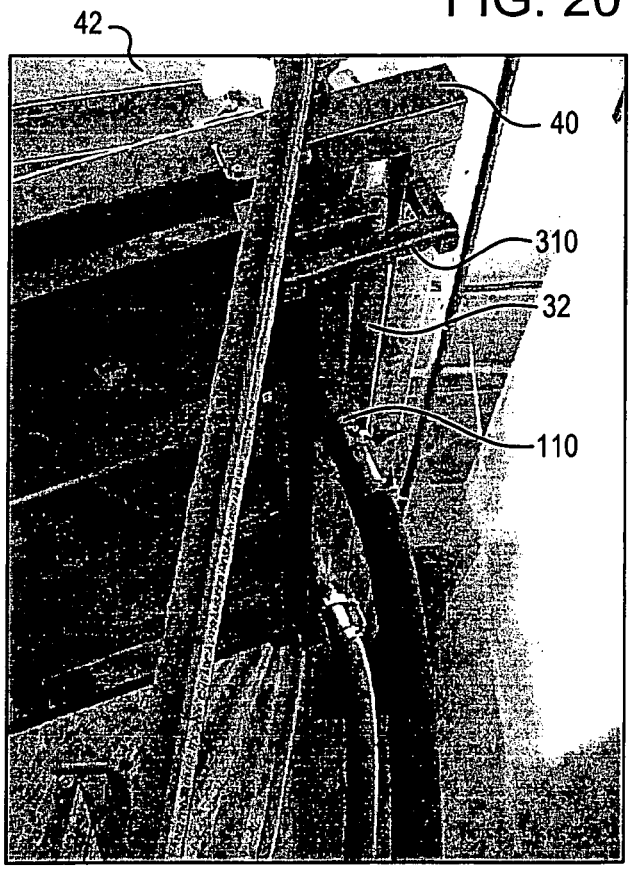

In FIG. 20, the inlet end of the support tray is shown, including the inlet floodbox support, as well as a pair of hoses which are connected to a pair of inlets to the inlet floodbox via quick disconnect sanitary fittings.

Figure 21:
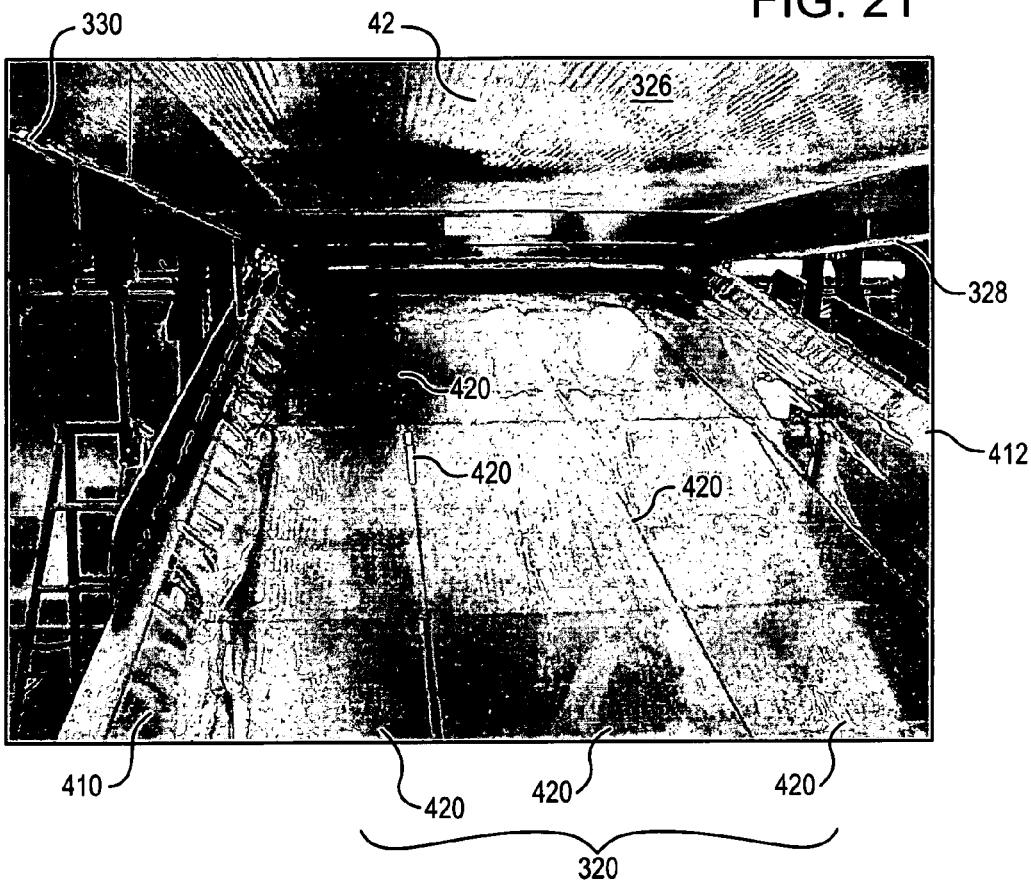

FIG. 21 provides a perspective photograph of the replaceable heat transfer module in working position on a support tray, and further illustrates the use of a plurality of removable, cleanable tray units, which in this embodiment are each rectangular stainless steel tray units.

Figure 22:
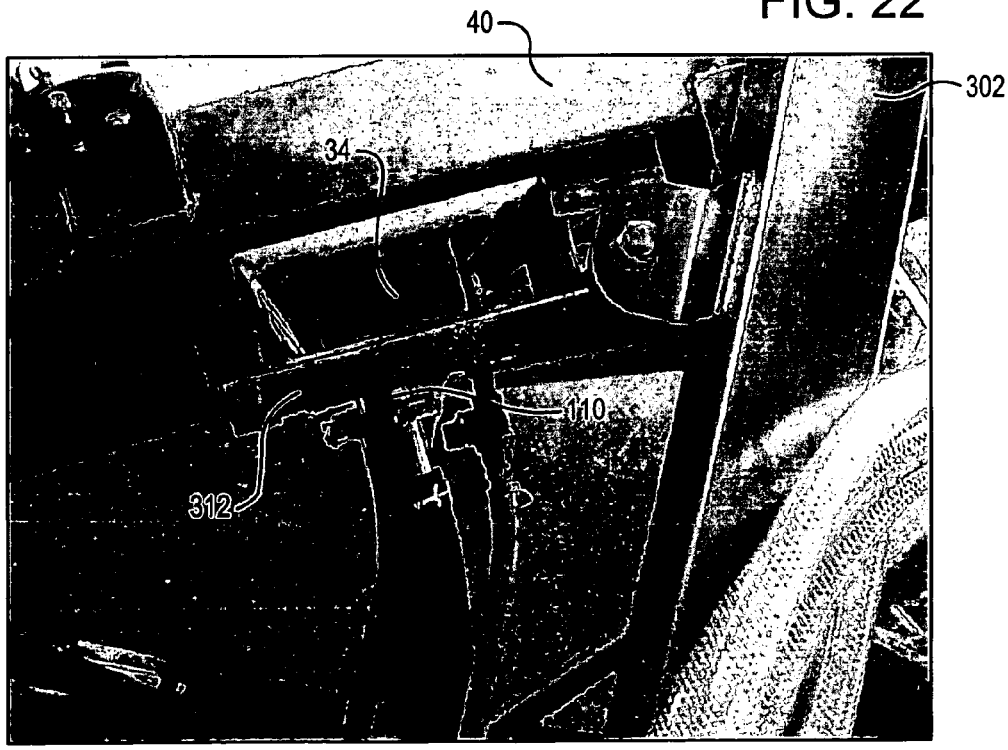

FIG. 22 shows the outlet manifold support at the lower end of the support tray, with the outlet manifold supported therein in a working position, with a plurality of outlet hoses affixed to outlets via quick disconnect fittings, and with a vacuum line connected to a vacuum outlet on the upper side portion of the outlet manifold.

Figure 23:
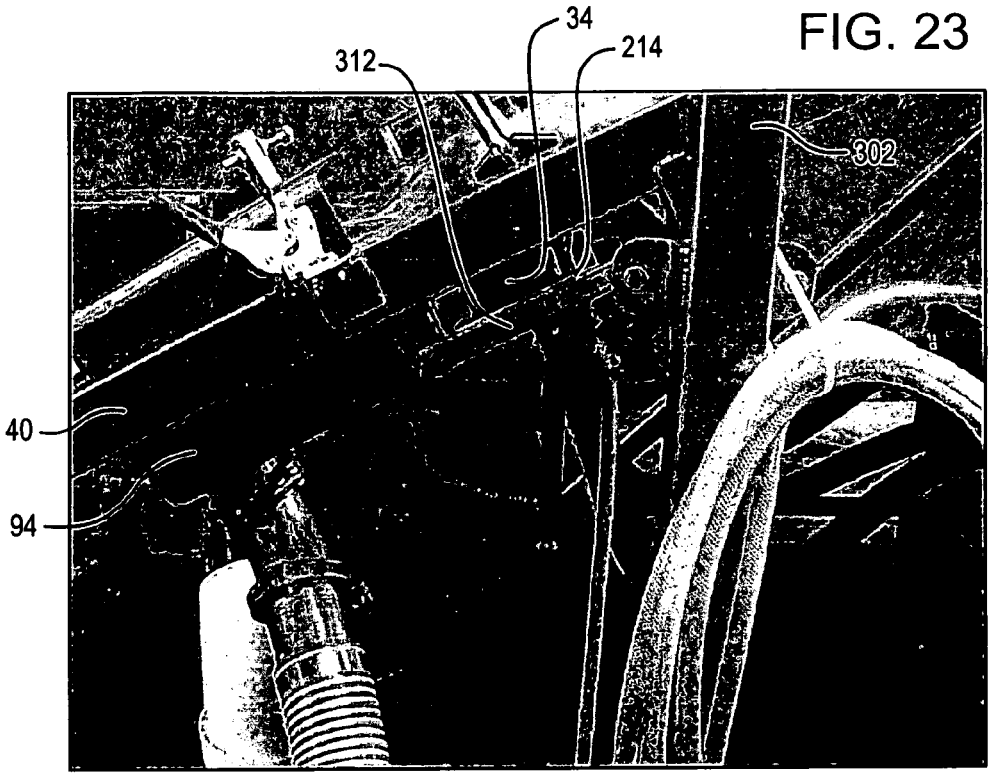

FIG. 23 is similar to FIG. 22, but now shows the outlet trough and the outlet nozzle from the product collection trough, and the product outlet hose.

Figure 24:
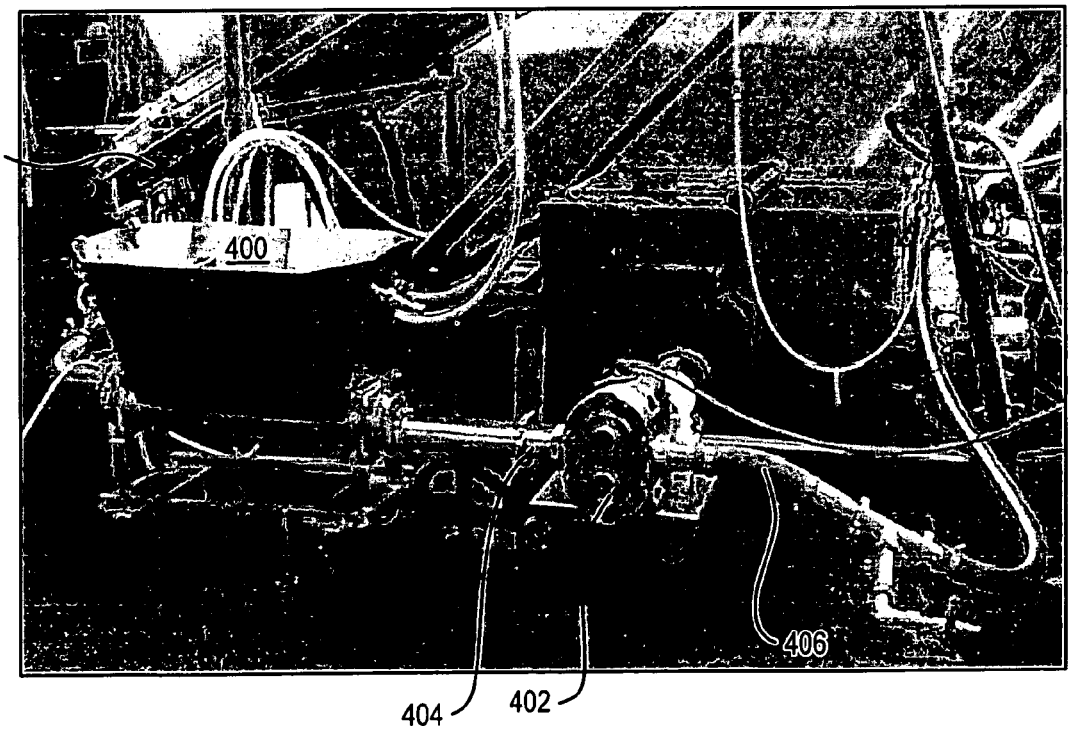

In FIG. 24, additional operating equipment is shown, including a product tank for receiving working product from the product outlet hose just seen in FIG. 23, and a positive displacement pump suitable for pumping a working product through the product supply hose up to the working product distributor.

Figure 25:
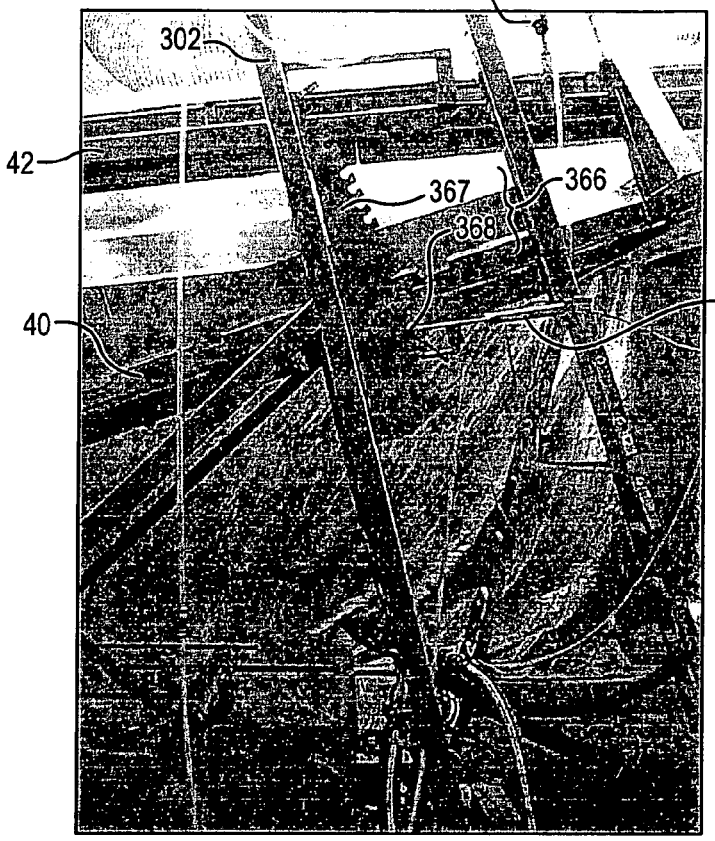

FIG. 25 shows the use of a toothed latch for a support tray lock, as well as the use of an actuation cylinder to move a retractable locking pin from an engaged, locked position to a retracted, unlocked position.

Figure 26:
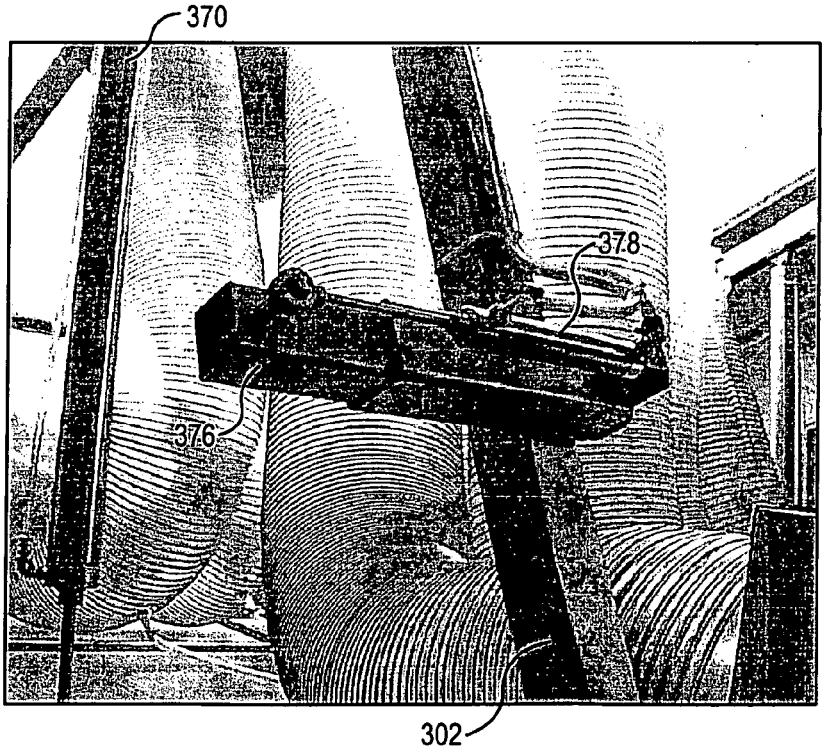

FIG. 26 illustrates a telescoping safety latch for securing the retractable hood independently of actuators which raise and lower the retractable hood; a nested extensible arm is extended and retracted via a small actuating cylinder to place the safety latch in an extended, locking position, or retract the safety latch into an unlocked position wherein the retractable hood is moveable.

Figure 27:
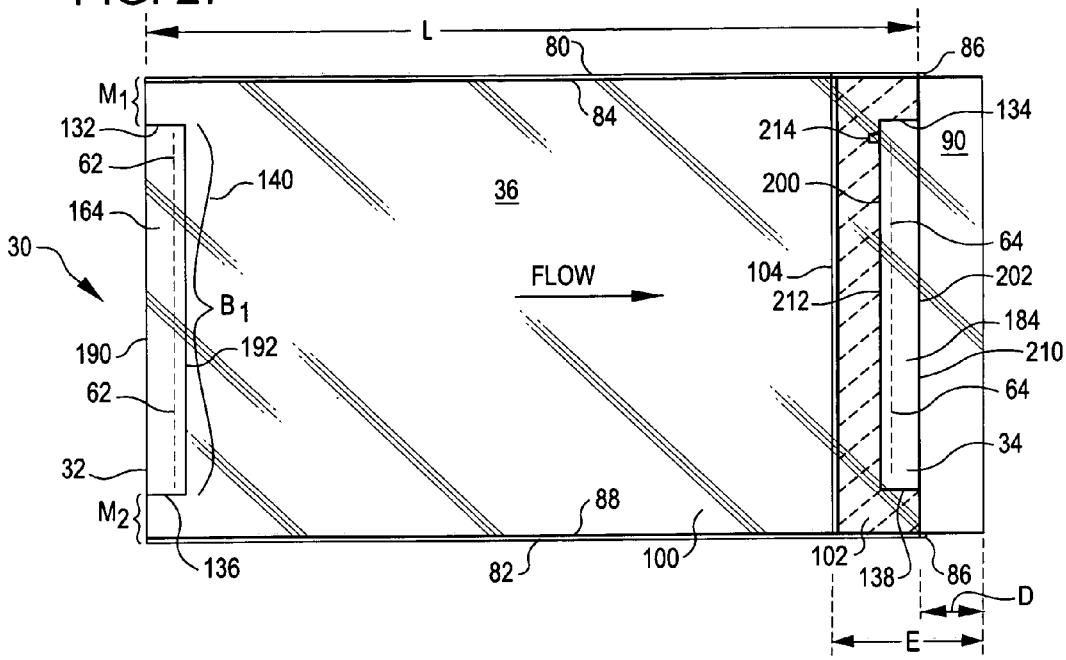

FIG. 27 illustrates the details of portions of one embodiment for a replaceable heat transfer module, specifically illustrating the lower flexible planar sheet and the upper flexible planar sheet and construction details which provide a fluid chamber.

Figure 1:
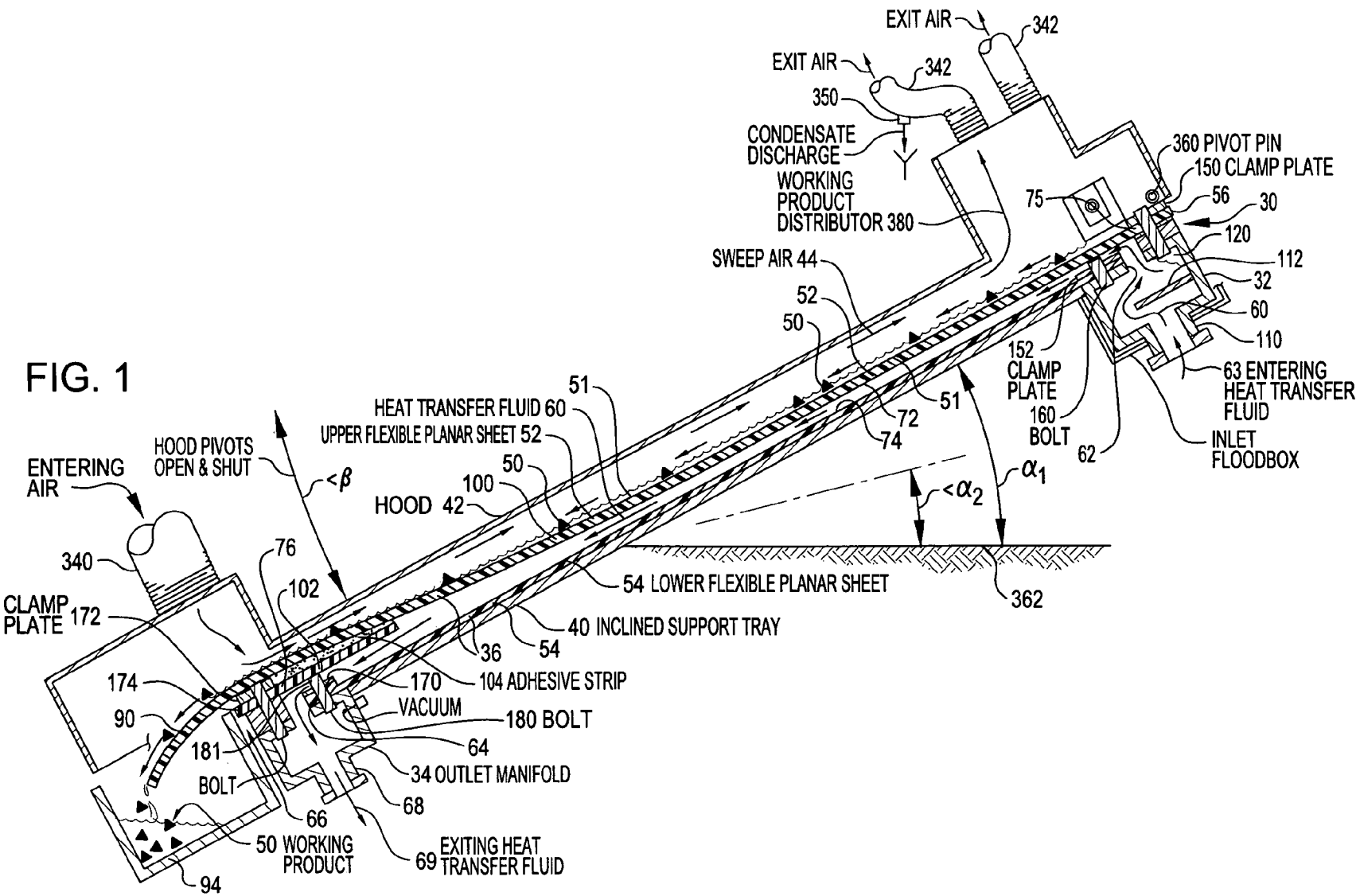
FIG. 1 side cross-sectional view of one embodiment of the replaceable heat transfer apparatus taught herein, showing in the sectioned illustrations the inlet flood box, the pair of flexible planar polyester sheets, an outlet manifold, as well as the adjustably inclined support tray, and a retractable hood, and a working product being distributed to the upper flexible planar sheet and flowing down to a working product collection pan.
Figure 28:
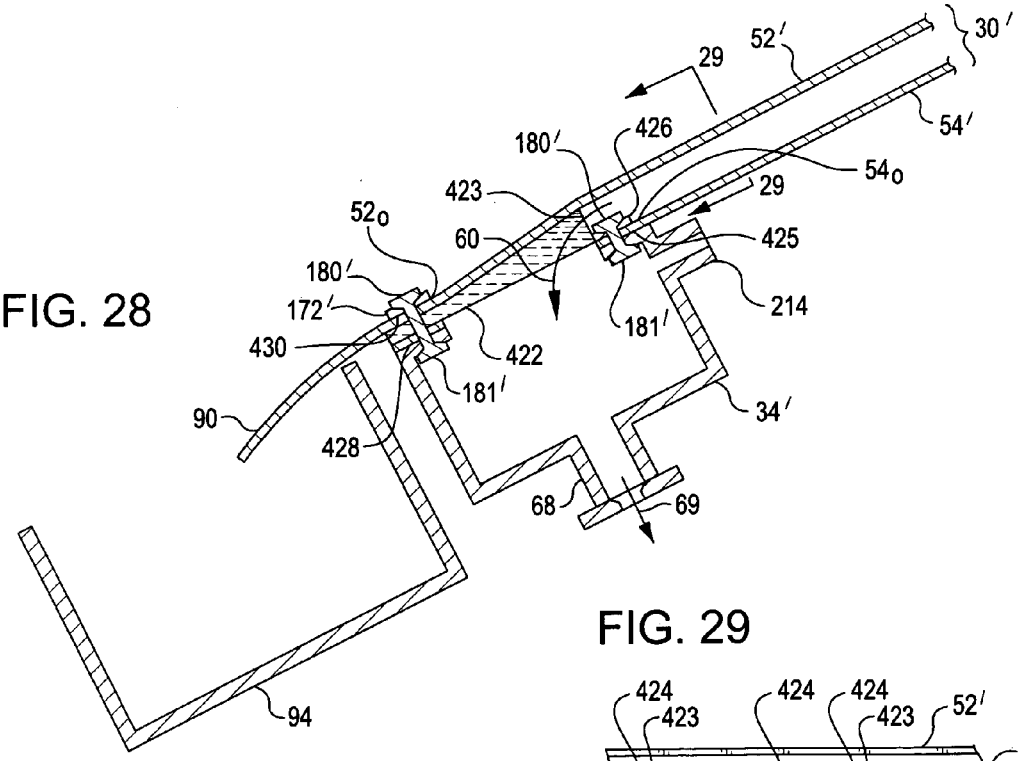

FIG. 28 illustrates the details of yet another embodiment for a replaceable heat transfer module, wherein instead of an overlapping seam as shown in FIG. 1, the outlet ends of the upper flexible planar sheet and the lower flexible planer sheet are spaced apart by a face block on the outlet manifold, and through which face block the heat transfer fluid exits, and against which face block the outlet ends of the upper and lower flexible planar sheets are secured.

Figure 29:
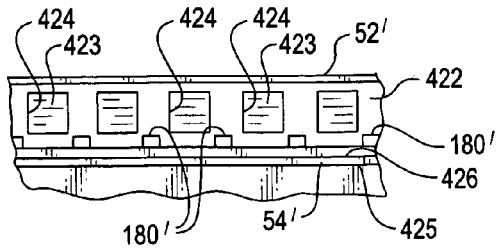

FIG. 29 illustrates, in partial view, a downstream view of the face block for an outlet manifold as just depicted in FIG. 28, now showing the individual fluid outlets and the upper and lower flexible planar sheets.

The foregoing figures, being merely exemplary, contain various elements that may be present or omitted from actual implementations and process configurations of the replaceable heat transfer module and the heat transfer module in which the module may be used for heating, evaporation, or cooling, depending upon the circumstances. An attempt has been made to draw the figures in a way that illustrates at least those elements that are significant for an understanding of the various embodiments and aspects of the invention. However, various other elements of the unique replaceable heat transfer module are also shown and briefly described to enable the reader to understand how various features, including optional or alternate features, may be utilized in order to provide a simple, cleanable, sanitary heat transfer module apparatus that can be manufactured in a desired size and configuration for providing a long lasting and superbly performing heating, cooling, or evaporation system.

DETAILED DESCRIPTION

The improvements described and claimed herein relate to methods and apparatus for providing a modular, replaceable, cleanable, sanitary heat transfer module for heating, concentrating or cooling products. More specifically, the improvement described herein is to provide a unique cleanable and replaceable heat transfer module 30, and an improved heat transfer apparatus in which the heat transfer module can be advantageously employed for chilling, heating, or evaporation of a selected working product.

As seen in FIG. 1, the heat transfer module 30 includes an inlet flood box 32, an outlet manifold 34, and an evaporator envelope 36 in a fluid tight relationship therebetween. The heat transfer module 30 is advantageously employed in an adjustably inclinable platform base support tray 40. To assist in achieving the desired heating, cooling, or evaporation result, a retractable hood 42 may be provided for the supply of sweep air 44. As illustrated in this embodiment, sweep air 44 may be configured to move countercurrently to the gravity flow of working product 50 downward across the upper side 51 of an upper sheet 52 of flexible planar material. A lower sheet of flexible planar material 54 is also provided. Each of the upper 52 and lower 54 flexible planar sheets may be provided in a suitable flexible substance. Suitable embodiments include infrared permeable materials, and more preferably, infrared transparent materials. In the embodiment illustrated, the use of a thin polyester, for example, Mylar® brand polyester film, formerly sold by E.I. du Pont de Nemours and Company, and now available from the DuPont joint venture, DuPont Teijin Films, has been taught, since such films are practically transparent to far infrared radiation and thus are advantageous especially for heat transfer applications. Also, such films are suitable for food grade service, and in heating or cooling service, with a variety of working product substances, for example, (a) liquids, or (b) slurries, (c) pumpable high viscosity materials, or (d) any substance or product material where particulates are included in (i) a liquid, (ii) a slurry, or (iii) a pumpable high viscosity material. As a further example, common working products which may be advantageously concentrated may include foods such as fruit or berry mixtures, such as raspberry puree.

The replaceable heat transfer module 30 is useful for providing thermal contact between a first heat transfer fluid 60 such as water, and a working product 50. The first heat transfer fluid 60 and the working product 50 are provided at differing temperatures.

At the upper end 56 of the heat transfer module 30, an inlet floodbox 32 includes at least one inlet 62 for entry (see reference arrow 63 in FIG. 1) of the first heat transfer fluid 60 into the heat transfer module 30. The inlet floodbox 32 includes a plurality of fluid distribution passageways 62 for discharge of the first heat transfer fluid 60.

At the lower end 66 of the heat transfer module 30, an outlet manifold 34 is provided. The outlet manifold includes a plurality of fluid collection passageways 64 for collection of the first heat transfer fluid 60 after the first heat transfer fluid 60 passes through the evaporator envelope 36. The outlet manifold 34 includes at least one outlet 68 through which the first heat transfer fluid 60 is discharged (see reference arrow 69 in FIG. 1). Two outlets 68 can be provided spaced equidistant from first 134 and second 138 ends of outlet manifold 34.

Extending in a fluid tight relationship between the plurality of fluid distribution passageways 62 and the plurality of fluid collection passageways 64, a thin, elongate evaporator envelope 36 is provided. The evaporator envelope has a lower flexible planar sheet 54 and an upper flexible planar sheet 52. The upper flexible planar sheet 52 and said lower flexible planar sheet 54 each having inner surfaces, 72 and 74, respectively, located in a back-to-back spaced apart relationship. In other words, two sheets of Mylar polyester are laid flat one over the other. The evaporator envelope 36 has an upper end 75 wherein the lower 54 and said upper 52 flexible planar sheets are fluidly sealed to the inlet floodbox 32. The evaporator envelope 36 has a lower end 76 wherein the lower 54 and upper 52 planar sheets are fluidly sealed to the outlet manifold 34. As seen in FIG. 27, at a first edge portion 80 and at a second edge portion 82, a narrow strip of the lower flexible planar sheet 54 and a narrow strip of the upper flexible planar sheet 52 are fluidly sealed together. As illustrated in FIG. 27, at the fluid seal along first edge portion 80, a first joint 84 is provided between lower flexible planar sheet 54 and upper flexible planar sheet 52, which is bonded or sealed by use of an adhesive, such as a suitable pressure sensitive adhesive 86, shown slightly extended for purposes of illustration only in FIG. 27. Similarly, at the fluid seal along second edge portion 82, a second joint 88 is provided between lower flexible planar sheet 54 and upper flexible planar sheet 52. The second joint 88 is bonded or sealed by use of an adhesive, such as by using a suitable two sided adhesive tape 86, again shown slightly extended for purposes of illustration only in FIG. 27.

In one embodiment, as shown in FIG. 1, and FIGS. 7–10, and FIG. 27, a tail collection sheet 90 is provided. The tail collection sheet 90 extends, in a downstream direction, past the outlet manifold 34 for a preselected distance D in order to carry a working product 50 to a working product collection pan 94. As illustrated in the embodiment shown in FIGS. 1 and 27, the tail collection sheet 90 is an integral extension of the upper flexible planar sheet 52. In such a situation, the upper flexible planar sheet 52 has an upstream or top end portion 100, and a downstream or bottom end portion 102, and in such a case, the bottom end portion 102 comprises an upstream edge fluidly sealed at a third joint 104 to the top end portion 100. Thus, in this embodiment, the bottom end portion 102 of the upper flexible planar sheet 52 is the component which provides the downstream edge fluidly sealed to the outlet manifold 34. This configuration is illustrated in FIGS. 1 and 27. As shown in FIG. 1, the third joint 104 between the bottom end portion 102 and the top end portion 100 is spaced upstream a preselected distance from the outlet manifold 34. In one embodiment, the preselected distance E is in the range from about 20 centimeters to about one meter.

Figure 2:
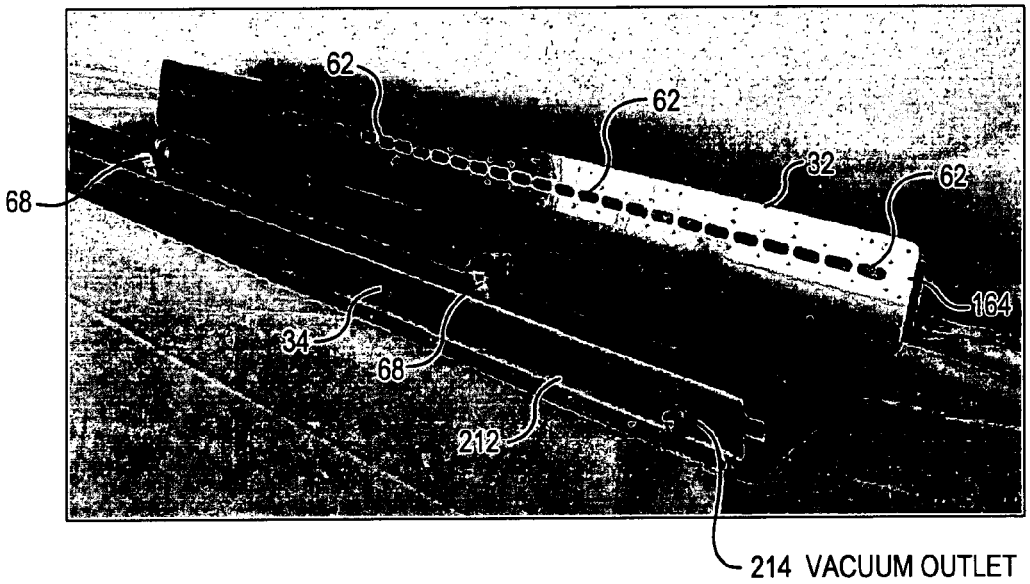
FIG. 2 provides a perspective photograph of one embodiment for an inlet floodbox (at the top) and an outlet manifold (at the bottom), showing the vacuum outlet on the upper edge of the outlet manifold, as well as a pair of sanitary quick disconnect type outlets for discharging a heat transfer fluid from the outlet manifold.
Figure 3:
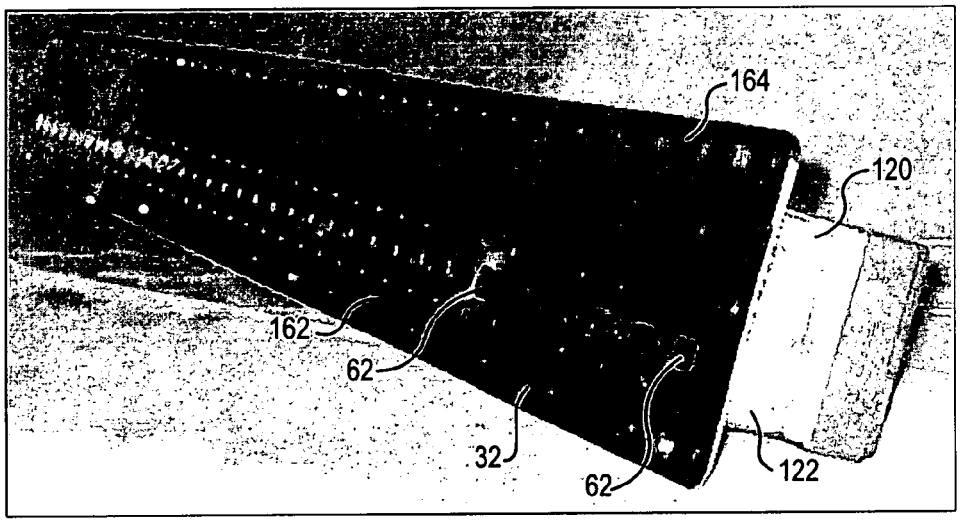
FIG. 3 provides a photograph of an inlet floodbox.

As see in FIGS. 2 and 3, the fluid distribution passageways 62 in the inlet floodbox 32 are arranged to distribute the first heat transfer fluid 60 substantially uniformly along the upper end 75 of FIG. 1 of the evaporator envelope so that the first heat transfer fluid 60 descends in a continuous film between the inner surfaces 74 and 72 of the lower and upper flexible planar sheets, respectively. The first heat transfer fluid 60 is provided to inlet floodbox 32 via an upflow configuration to at least one inlet 110, and thence through the inlet floodbox 32 past internal baffles 112 (see FIG. 1), and thence to the liquid distribution passageways 62. The internal baffles 112 are oriented to break the force of the first heat transfer fluid 60 entering through each one of the inlets 110 provided, so as to evenly distribute the first heat transfer fluid 60. A pair of inlets 110 can be provided, spaced apart equidistant between first 132 and second 136 ends of the inlet floodbox 32, which is oriented transversely with respect to the flow of the first heat transfer fluid 60, and thus to the length of evaporator envelope 36. As illustrated in FIG. 1, and as perhaps best visualized from FIG. 3, the inlet floodbox 32 has an upper internal headspace 120 which is configured to contain a trapped air bubble, so as to provide for a free weir action of water exiting through the liquid distribution passageways 62. A trough portion 122 provides a liquid reservoir within inlet floodbox 32.

Overall, in one embodiment, the replaceable heat transfer module may be provided in a configuration wherein the lower 54 and said upper 52 flexible planar sheets have a thickness on the order of millimeters or fractions thereof (for example, a polyester sheet with a thickness of about 3 to 8 mils may be useful in some applications). The internal working space for carriage of the first heat transfer fluid 60, between the inner surface 74 of the lower flexible planar member 54 and the inner surface 72 of the upper flexible planar member 52 is of a size on the order of centimeters. The overall evaporator envelope has a length L in FIG. 27, between the inlet floodbox 32 and the outlet manifold 34, on the order of meters, such as in the 4 to 10 meter range, though it may be shorter or longer than this range, depending on the application.

To help secure the working product and avoid loss, in one embodiment as illustrated in FIG. 27, the evaporator envelope 36 has a first marginal width area $M_1$ extending transversely beyond a first end 132 of the inlet floodbox 32 and a first end 134 of the outlet manifold 34, to edge 80. Likewise, on the other side, evaporator envelope 36 has a second marginal width $M_2$ extending transversely beyond a second end 136 of the inlet floodbox 32 and a second end 138 of the outlet manifold 32, out to edge 82. For clarity, in such a case, the evaporator envelope 36 is considered to also include a base 140 of width $B_1$ and which runs, lengthwise substantially between the inlet floodbox and said outlet manifold. In such a situation, as better illustrated in FIGS. 7, 9, and 15, the first marginal width $M_1$ and second marginal width $M_2$ are sized and shaped for sloping outwardly and upwardly from the base width $B_1$ to provide a generally flat bottomed V-shaped trough running from the inlet floodbox 32 to the outlet manifold 34 for containment of a selected working product 50.

Figure 6:
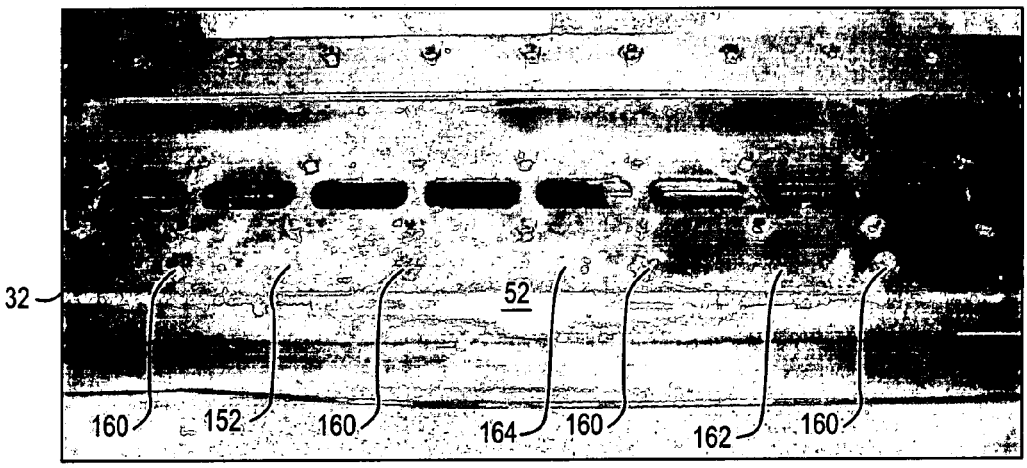
FIG. 6 is a perspective view of one embodiment of an inlet floodbox, showing the upper mounting clamp used to secure the upper flexible planar sheet to the inlet floodbox, as well as some of the fasteners (here, bolts) used to space the upper flexible planar sheet outward from the liquid distribution passageways.
Figure 7:
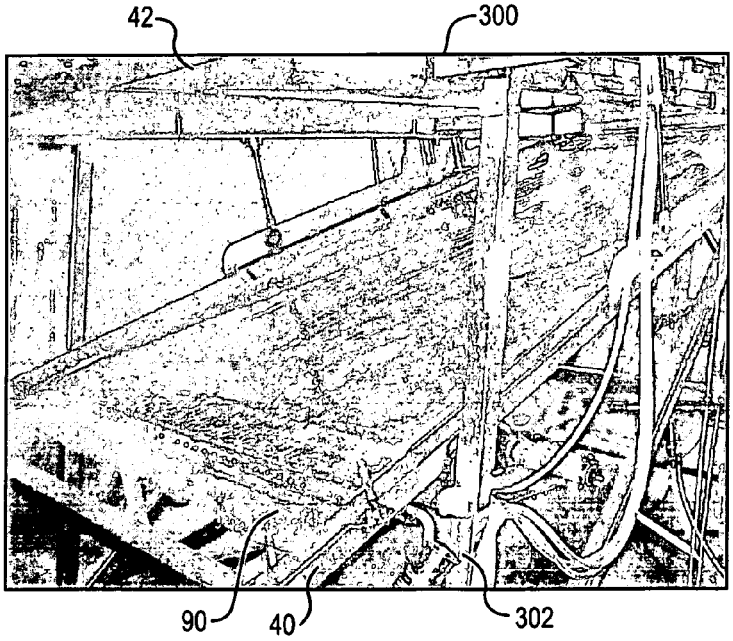
FIG. 7 shows a heat transfer apparatus as taught herein, with the support structure, adjustably inclinable support tray, a replaceable heat transfer module in operable location on the support tray, and the retractable air hood in an up, normally non-operating position wherein it is distanced away from the replaceable heat transfer module.
Figure 8:
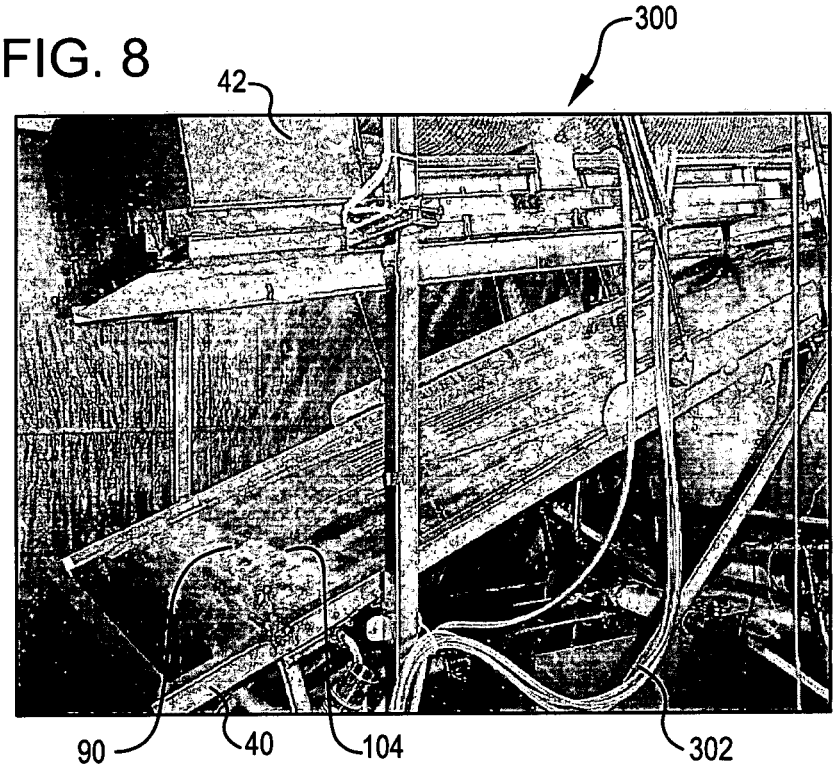
FIG. 8 is a view similar to the view first shown in FIG. 7, but now showing additional details of the orientation of the retractable hood, and a safety latch used to secure the retractable hood in an open condition without dependence on an telescoping cylinder; also shown is an air actuated cylinder, such as a Bimba® brand (or equivalent) which can be utilized to increase or decrease the angle at which the support tray is inclined.
Figure 9:
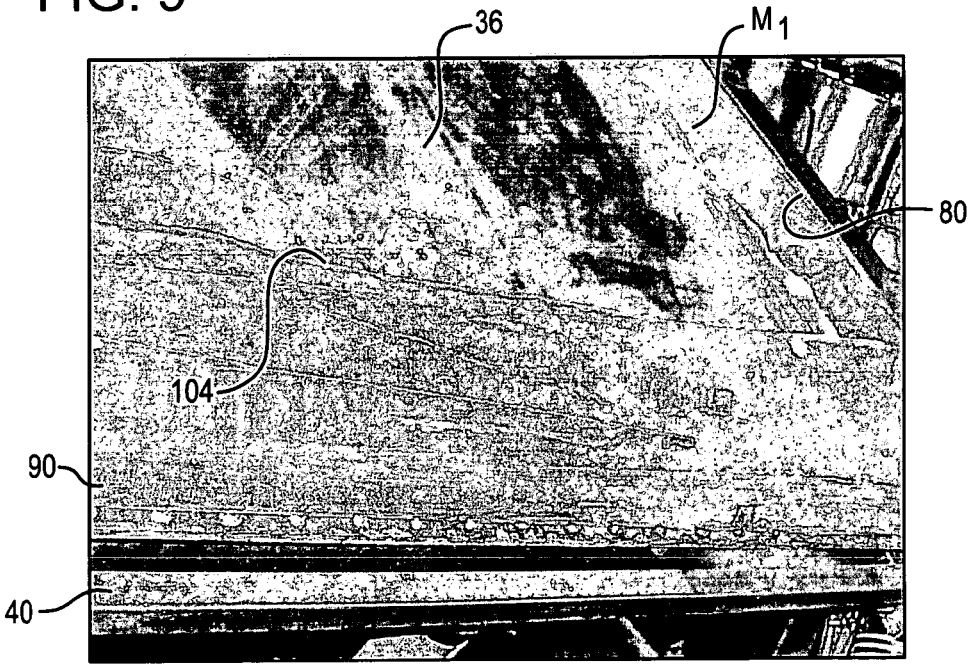
FIG. 9 is a photograph of the lower end portion of the replaceable heat transfer module, showing the use of a tail collection sheet, where the tail collection sheet extends past the outlet manifold for a preselected distance in order to carry the working product to a working product collection pan; also visible in this view are the upwardly and outwardly sloping sidewall portions of the support tray, which cradle the evaporator envelope marginal portions to provide a flat bottomed V-shape area to contain the working product during evaporation.
Figure 10:
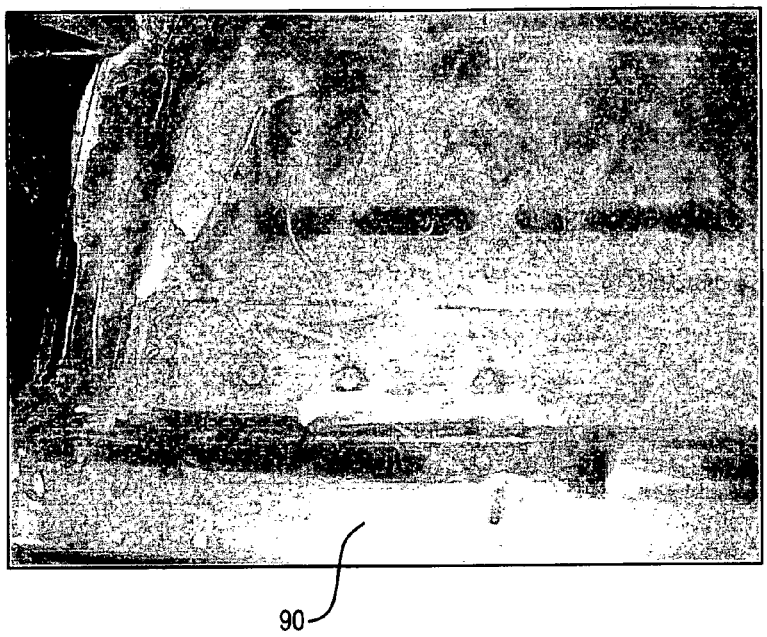
FIG. 10 is a close up photograph of a small part of the lower end portion of the replaceable heat transfer module first shown in FIG. 9, now showing in additional detail the use of a tail collection sheet, where the tail collection sheet extends past the outlet manifold for a preselected distance in order to carry the working product to a working product collection pan.
Figure 11:
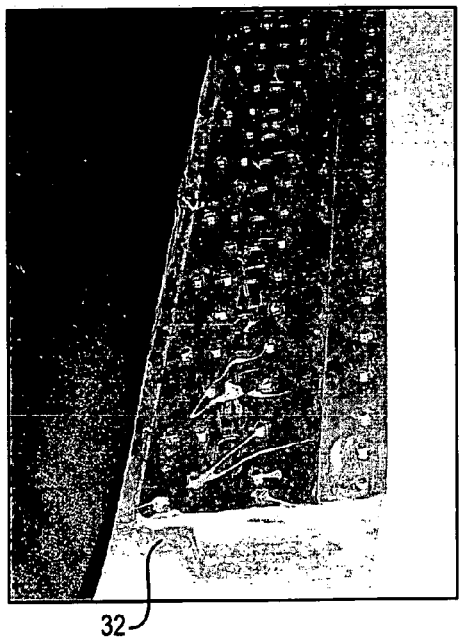
FIG. 11 is a close up photograph of a portion of the inlet floodbox, showing the use of a lower inlet clamp to secure the lower flexible planar sheet to the inlet floodbox.
Figure 12:
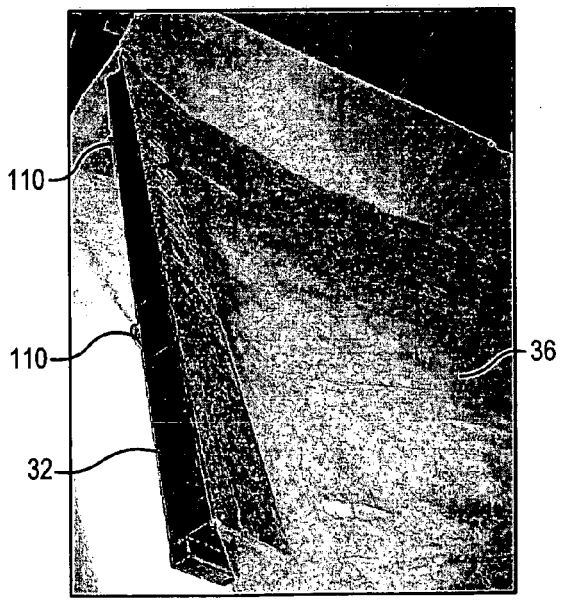
In FIG. 12, both the lower flexible planar sheet and the upper flexible planar sheet are shown affixed in a fluidly sealed condition to the inlet floodbox; also seen at a first end of the inlet floodbox is a marginal area of the evaporator envelope which extends transversely beyond the first end of the inlet floodbox.

As indicated in FIG. 1, the inlet floodbox 32 has inlet upper clamp or clamp plate 150, which secures the upper flexible planar sheet 52 to the inlet floodbox 32. Also, the inlet floodbox 32 has an inlet lower clamp 152, which secures the lower flexible planar sheet 54 to the inlet floodbox 32. As seen in FIG. 6, for example, the inlet lower clamp 152 is secured to the inlet floodbox 32 with a plurality of upwardly protruding fasteners 160. The upwardly protruding fasteners 160 support the upper flexible planar sheet 52 a spaced apart distance from the upper surface 162 of cover plate portion 164, and thus from the plurality of fluid distribution passageways 62, so that the first heat transfer fluid 60 can freely flow from the fluid distribution passageways 62 to the evaporator envelope 36. In one embodiment illustrated, suitable fasteners 160 may be bolts with heads.

In a similar fashion, as shown in FIG. 1, to the inlet floodbox construction, at the outlet manifold 34, an outlet lower clamp 170 is provided which secures the lower flexible planar sheet 54 to the outlet manifold 34. Also provided at the outlet manifold 34 is an outlet upper clamp plate 172 which secures said downstream edge 174 of the bottom end portion 102 of the upper flexible planar sheet to the outlet manifold 34. In one embodiment, the outlet lower clamp 170 is secured to the outlet manifold 34 with a plurality of upwardly protruding fasteners 180. The upwardly protruding fasteners 180 support the lower end portion 102 of the upper flexible planar sheet 52 a spaced apart distance from the upper surface 181 of outlet lower clamp 170 (and thus even further from upper surface 182 of cover plate portion 184 of the outlet manifold 34), and thus from the plurality of fluid collection passageways 64, so that the first heat transfer fluid 60 can freely flow from the evaporator envelope 36 and into the fluid collection passageways 64. Outlets 68 from the outlet manifold 34 can include a quick connect sanitary fitting. Such fittings are useful generally for the inlets 110 also, as well as joints in the working product flow circuit.

Turning now to FIG. 27, the inlet face (plate) cover portion 164 has an upper end 190 and lower end 192, flow-wise, and the liquid distribution passageways 62 are provided closer to the lower end 192 than to said upper end of the inlet face cover portion 164. In one embodiment, this split may be located at roughly one-third of the distance between lower end 192 and upper end 190. Likewise, in the outlet manifold 34, the outlet manifold outlet face (plate) cover portion 184, the liquid collection passageways 64 are provided in the outlet face (plate) cover portion 184. The outlet face cover portion 184 has an upstream 200 end and a downstream end 202, and the liquid collection passageways 64 are provided in the inlet face cover portion 184 closer to the upstream end 200 than to the downstream end 202. Again, in one embodiment, the location of the passageways 64 can be about one third of the way along the inlet face cover portion 184, flow-wise, or on the upstream end.

Figure 5:
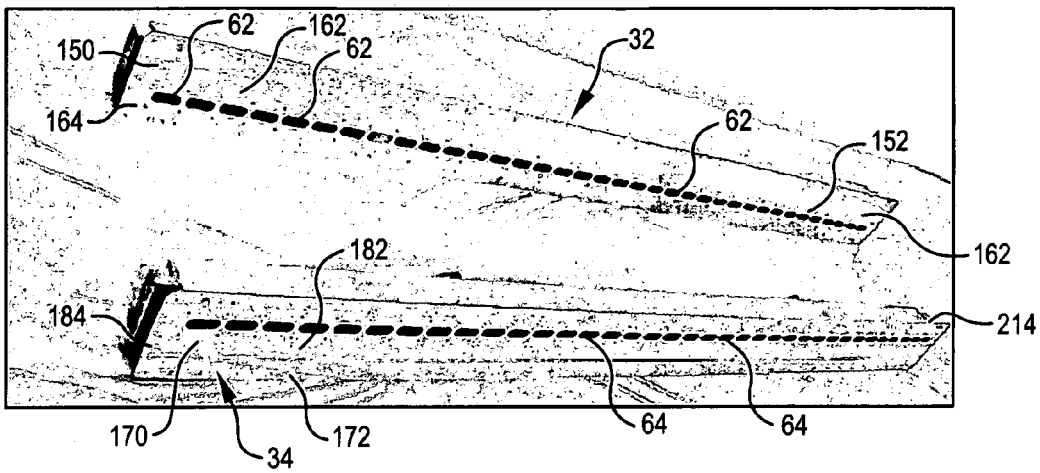
FIG. 5 provides a perspective view of one embodiment for an inlet floodbox (at the top) and an outlet manifold (at the bottom), showing the liquid distribution passageways in the inlet floodbox, and the liquid collection passageways in the outlet manifold, as well as mounting locations for bolts which are used to affix, via suitable clamps, upper and lower flexible planar sheets to the apparatus, as further described herein.

Although a variety of shapes may be utilized for fluid distribution and collection structures, in one embodiment illustrated for example in FIG. 5, each one of the plurality of fluid distribution passageways 62 and each one of the plurality of fluid collection passageways 64 are configured in a substantially parallelepiped orientation with smooth, rounded corner portions, and wherein the long portion of parallelepiped passageways extends in a side to side orientation with respect to the evaporator envelope 36.

Figure 4:
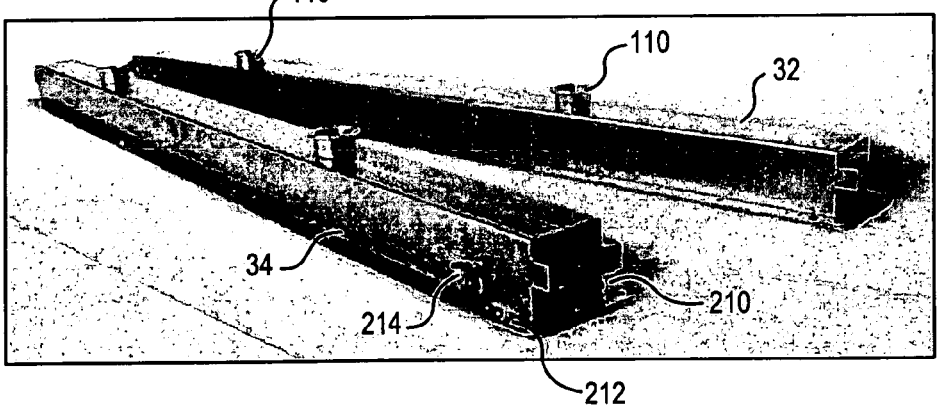
FIG. 4 provides a perspective view of one embodiment for an inlet floodbox (at the top) and an outlet manifold (at the bottom), showing the vacuum outlet on the upper edge of the outlet manifold, as well as a pair of sanitary quick disconnect type inlets in the inlet floodbox, as well as a pair of sanitary quick disconnect type outlets for discharging a heat transfer fluid from the outlet manifold.

As shown in FIG. 4, the outlet manifold 34 is shaped as an elongate trough having upper edge portions 210 and 212. As indicated in FIGS. 2, 4, and 23, the outlet manifold further includes at least one fluid outlet 214 passageway adjacent at least one of the upper edge 212 which is adapted for vacuum service, so that vacuum may be applied to remove air from the outlet manifold 34 when the outlet manifold is filled with a heat transfer fluid such as hot or chilled water.

Figure 13:
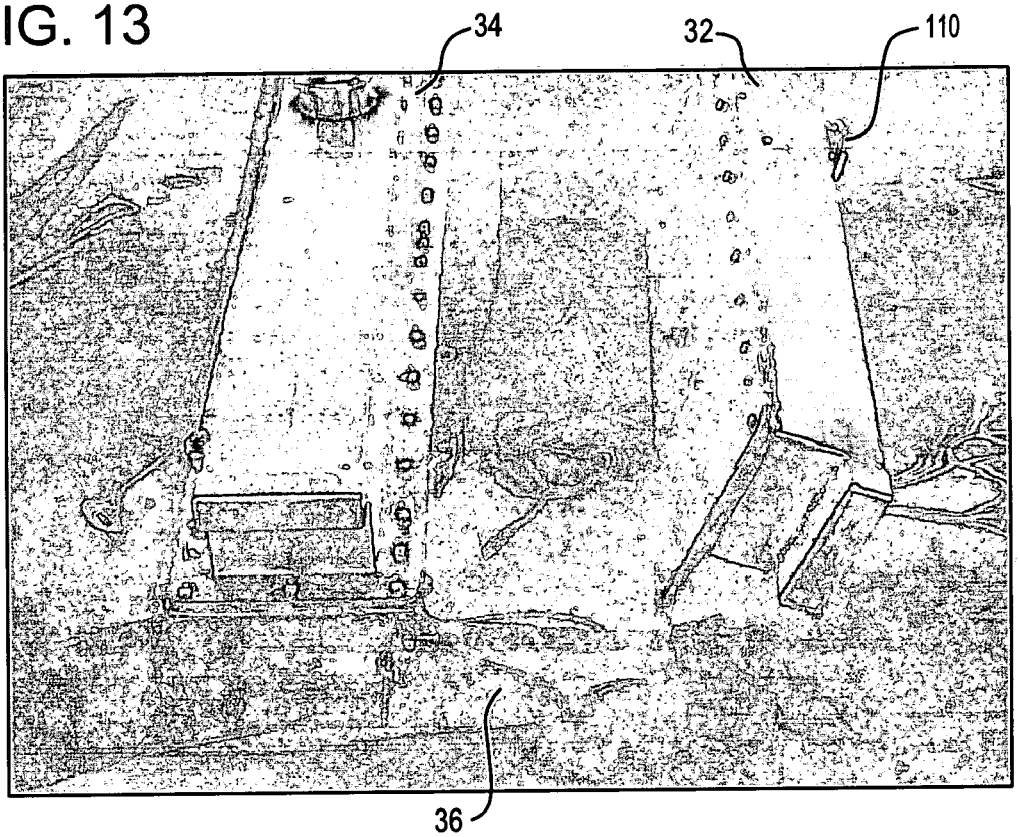
FIG. 13 illustrates the flexible nature of the upper and lower flexible planar sheets, and provides an indication that the replaceable heat transfer module, including the inlet floodbox, and outlet manifold may be folded or rolled into a compact package for shipment as a replacement kit.
Figure 14:
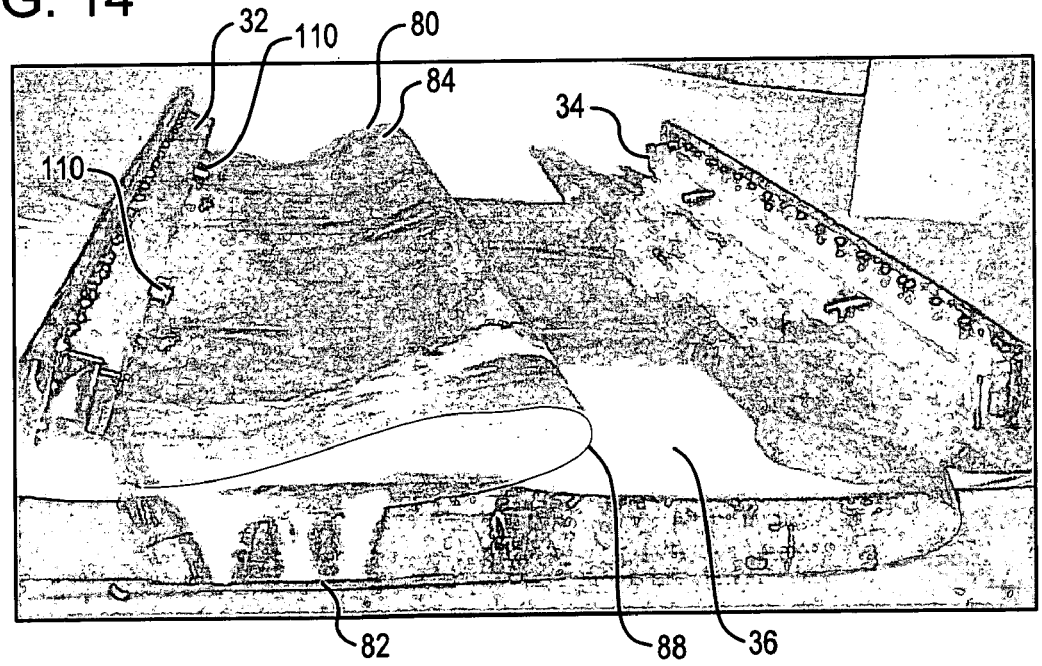
FIG. 14 further illustrates the flexible nature of the upper and lower flexible planar sheets, and provides confirmation that the replaceable heat transfer module, including the inlet floodbox, and outlet manifold may be folded or rolled into a compact package for shipment as a replacement kit.

When the replaceable heat transfer module 30 is filled with a heat transfer fluid, the evaporator envelope 36 is strong, monocoque structure. However, as seen in FIGS. 13 and 14, the lower 54 and upper 52 flexible planar sheets are sufficiently flexible and resilient that the replaceable heat transfer module 30, when not containing a heat transfer fluid, can be folded or rolled into a compact, shippable package including the evaporator envelope 36, the inlet floodbox 32, and the outlet manifold 34.

Figure 15:
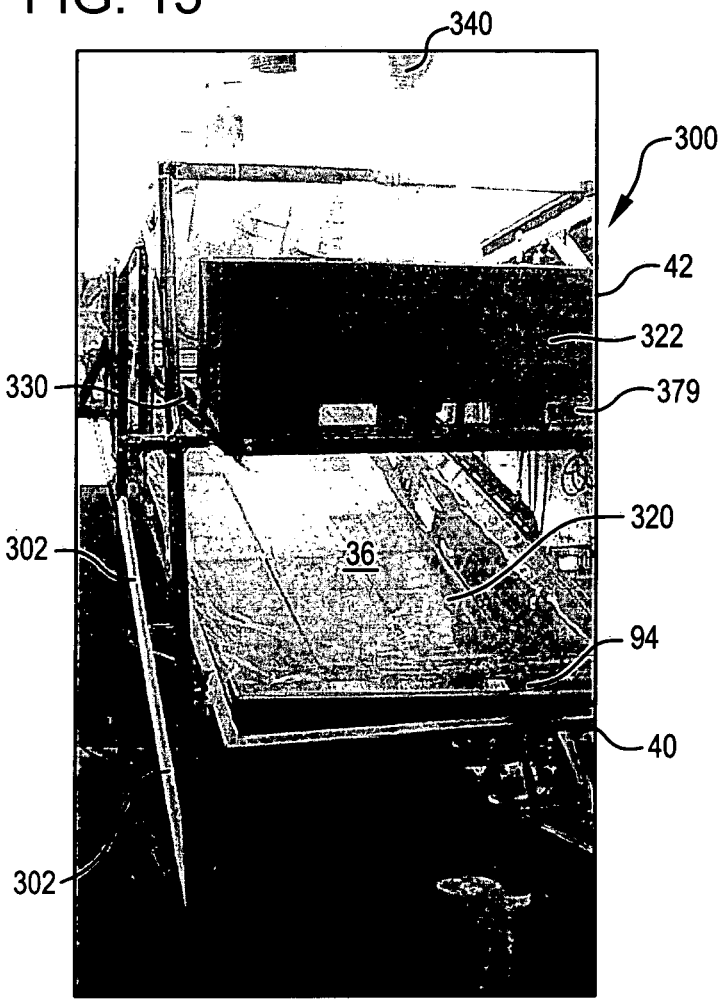
FIG. 15 shows a heat transfer apparatus utilizing a replaceable heat transfer module, showing the adjustably inclinable support tray, and a retractable hood.
Figure 16:
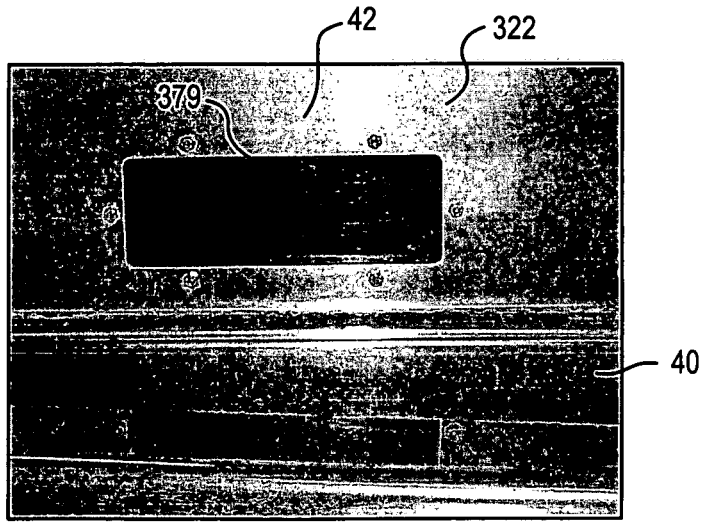
In FIG. 16, a sight window provided in the retractable hood portion; several of such windows may be provided (see FIG. 15, for example) to allow an operator to view the working product located on the evaporator envelope during evaporation or product chilling operations.

Attention is now directed to FIGS. 15 though 26, where further details are shown of an exemplary heat transfer apparatus 300 designed for utilization of the replaceable heat transfer module 30 disclosed above. The heat transfer apparatus 300 has a structural base 302 and an adjustably inclinable support tray 40 that is adjustably affixed to the structural base 302. The adjustably inclinable support tray 40 is sized, shaped, and configured to support in an operational position the replaceable heat transfer module 30 just described. Thus, the inclinable support tray 40 has an inlet floodbox support 310, an outlet manifold support 312, and extending substantially between the inlet floodbox support 310 and the outlet manifold support 312, a generally flat support pan 320 having a length and a width. The replaceable heat transfer module 30 is adjustably affixed to the support tray 40, and tension between the inlet flood box 32 and the outlet manifold 34 may be adjusted as operation begins and or continues.

A retractable hood 42 is provided. The retractable hood 42 includes an air inlet plenum 322, an air outlet plenum 324, and extending between the air inlet plenum 322 and the air outlet plenum 324, a sweep air plenum 326. The sweep air plenum 326 is configured to substantially match the length and width of the inclinable support tray 40. The hood, including the sweep air plenum 326, is retractably affixed to the structural base 302. As illustrated in FIGS. 15, 18, 19, and 21, the sweep air plenum 326 has first 328 and second 330 side portions configured for close fitting mating engagement with the support pan 320, so that air passing through the sweep air plenum 326 is substantially prevented from escaping outward between the sweep air plenum 326 and the support pan 320. Usually (but not necessarily) the inlet air duct 340 and the outlet air duct 342 are arranged for counter-current flow of air with respect to flow of the first heat transfer fluid 60 and the working product 50, which flow co-currently, by gravity. As seen in FIG. 18, the outlet air ducts may include a drain outlet 350, which is configured to trap for discharge any liquids arriving at or condensing in the air outlet duct 342.

As seen in FIG. 1 and FIG. 17, the adjustably inclinable support tray 40 and the retractable hood 42 are pivotally joined at pivot pin 360. As indicated, the support tray 40 and the retractable hood 42 are pivotally joined adjacent the inlet floodbox 32 support. As indicated in FIG. 1, the support tray 40 is adjustable to a selected downwardly sloping angle alpha (a), with respect to a horizontal reference plane 362. In various embodiments, the selected downwardly sloping angle alpha ($\alpha$) can be established between about 30 degrees and about 45 degrees. However, for a particular application, the selected downwardly sloping angle alpha ($\alpha$) may be larger than about 45 degrees. Or for other heat transfer situations, the selected downwardly sloping angle alpha ($\alpha$) may be less than about 30 degrees. For movement of the support tray 40, at least one adjustable support tray actuator 370 is provided. The support tray 40 is adjustably raised and lowered to said preselected angle alpha ($\alpha$) by movement of the at least one support tray actuator 370. In the embodiment shown in FIG. 18, the at least one adjustable support tray actuator 370 is a telescopic cylinder, which may be provided in a pneumatic or hydraulic actuator. One convenient design is to use air actuated cylinders.

To enhance safety, a support tray lock 366 may be provided. As seen in FIG. 25, one embodiment for such a lock includes a toothed latch 367 and a retractable pin 368. The retractable pin 368 is sized and shaped for movement between (1) a locking position in which the pin rests in the toothed latch 367 to lock the support tray 40 at a selected first position, and (2) a retracted position, in which the support tray 40 can be moved to another desired angle alpha ($\alpha$). For convenience, the retractable pin 368 is moved by a hydraulic or pneumatic actuator 369.

With respect to the hood 42, as indicated in FIG. 1, the retractable hood 42 is pivotable (at pivot pin 360) to a selected upwardly sloping angle beta ($\beta$), with respect to the support tray 40. To raise the hood 42, at least one retractable hood actuator 372 is provided. Thus, the retractable hood actuator 372 is adjustably raised and lowered to a preselected angle beta ($\beta$) by movement of the retractable hood actuator(s) 372. Such actuators may be a telescopic cylinder, such as a pneumatic or hydraulic actuator. As seen in FIG. 26, to enhance safety, on structural base 302, a retractable hood safety catch 376 can be provided. The safety catch 376 is movable into a hood 42 support position to secure the retractable hood 42 in an open position independently of the actuators 372. Safety catch actuators 378 can be provided for hydraulically or pneumatically moving the safety catch 376. To see inside of the hood 42 during operation, one or more sight windows 379 can be provided. The sight windows 379 can be sized and shaped to allow viewing of flow of working product along the evaporator envelope 36.

For operation, to distribute working product on the evaporator envelope 36, adjacent the inlet floodbox 32 and in close proximity to the upper flexible planar sheet 52, a working product distributor 380 is provided. The working product distributor 380 configured to distribute a working product 50 on to the upper flexible planar sheet 52, so that the working product 50 may flow by gravity downward along the upper flexible planar sheet 52. At the lower end, a working product collection pan 94 is provided to pick up working product as it leaves the tail collection sheet 90.

Turning now to FIG. 24, details of the method of use are seen. A product tank 400 is fluidly connected to receive working product 50 collected by the working product collection pan 94. A positive displacement pump 402 is provided, wherein the pump 402 has an inlet 404 configured to receive working product 50 from the product tank 400, and an outlet 406 configured to discharge working product 50 to the working product distributor 380.

As seen in FIG. 21, and noted schematically in FIG. 27, the evaporator envelope 36 has a first marginal width $M_1$ extending transversely beyond the first end of the inlet floodbox and the first end of the outlet manifold, and lengthwise from the inlet floodbox to the outlet manifold. Also, a second marginal width $M_2$ is provided between the second end of the inlet floodbox and the second end of the outlet manifold, and lengthwise between the inlet floodbox and the outlet manifold. Since the support tray 40 has, transversely, upwardly and outwardly extending sidewall portions 410 and 412 that extend from lateral edges of the support pan 320, the sidewall portions 410 and 412 are configured to provide a generally flat trough with sloping sides to carry working product. Thus, the evaporator envelope 36 conforms to such shape, since the marginal width $M_1$ and $M_2$ of the evaporator envelope are sized and shaped to generally match the sidewall portions 410 and 412 and thus the evaporator envelope slopes outwardly and upwardly from the support pan 320. As seen in FIG. 21, the support pan portion 320 of the support tray 40 can be provided with a plurality of removable, cleanable tray portions 420.

Turning now to FIG. 28, the details of yet another embodiment for a replaceable heat transfer module 30' are shown, Here, a face block 422, is provided for outlet module 34'. Instead of an overlapping seam for the bottom of the heat transfer envelope, as shown in FIG. 1, the outlet end $52_o$ of the upper flexible planar sheet and the outlet end $54_O$ of the lower flexible planer sheet are spaced apart by a face block 422 on the outlet manifold 34'. The heat transfer fluid 60 passes through and exits outward via orifices 423, defined by edge walls 424. Heat transfer fluid 60 thence flows into the interior of outlet manifold 34'. In this embodiment, the outlet end $54_O$ of the lower flexible planar sheet 54' is secured against seal face 425 by a lip 426 of face block 422 and fasteners such as bolts 180' and accompanying nuts 181'. The orifices 423 and their edge walls 424 are better seen in FIG. 29. Also seen in FIG. 29 is how fasteners 180' secure lip 426 against lower planar sheet 54'. Likewise, the lower end $52_O$ of the upper flexible planar sheet 52' is secured against sealing face 428 on face block by outlet upper clamp 172', which has a lower side 430 which presses against lower end $52_O$ of the upper flexible planar sheet 52', and thence into the sealing face 428 of block 422. Thus, in this fashion, The heat transfer apparatus 300 provides a tool for practice of a process for evaporation of liquid from a working product 50. The working product can be a liquid, or a slurry, or pumpable high viscosity material, or any substance or product material where particulates are included in a liquid, a slurry, or a pumpable high viscosity material. The process involves providing a heat transfer apparatus as described herein, including a retractable hood as set forth herein, and placing the hood in a working location in close proximity to the support tray, configured to substantially preclude sweep air from escaping. A first heat transfer fluid, such as hot water, is introduced into the inlet floodbox. A flow of the first heat transfer fluid at a preselected inlet temperature is established. A working product is distributed on the evaporator envelope. The working product is allowed to flow by gravity to a working product collection pan. Solvent removed from the working product is captured in a sweep air stream running countercurrent to the flow of the working product. The angle alpha of the support tray 40 can be adjusted to maintain desired throughput and concentration or dryness of the working product. In one embodiment the process may be utilized on a food material. Food materials especially suited for processing in the apparatus include fruit mixtures, or berry mixtures, or juices. As a further enhancement, the sweep air stream may be conditioned to a desired temperature and humidity level to assist removal of solvent from the working product. Or, the sweep air stream may be simply ambient air, if suitable.

In yet another embodiment, a working product may be chilled in the heat transfer apparatus 300. In such a case, the first heat transfer fluid may be chilled water or a suitable brine composition. As when the heat transfer apparatus is utilized for heating or drying, when chilling is desired, the sweep air stream may be conditioned to a desired temperature and humidity level to assist I in chilling of the selected working product.

Although various aspects and elements of the invention are herein disclosed for illustrative purposes, it is to be understood that the replaceable heat transfer module, and the method of use of the replaceable heat transfer module in thin film heating, drying, evaporation, and chilling systems, are important improvements in the state of the art of devices and methods for handling materials in thin film heat transfer systems with cleanable, sanitary, replaceable heat transfer components. Although only a few exemplary aspects have been described in detail, various details are sufficiently set forth in the figures of the drawing and in the specification provided herein to enable one of ordinary skill in the art to make and use the invention(s), which need not be further described by additional writing in this detailed description. Importantly, the aspects and embodiments described and claimed herein may be modified from those shown without materially departing from the novel teachings and advantages provided as described herein, and may be embodied in other specific forms without departing from the spirit or essential characteristics thereof. It is especially pointed out that the size, and extent of a desirable heat transfer module, and especially the shapes for liquid distributors and liquid collectors, or the length and width of an evaporation envelope, and the amount of material handled thereby, will vary widely based on the nature of the working products provided, and based on the chilling, heating, or evaporation conditions used, especially when a residual solvent (such as water) is removed. Therefore, the embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. It is therefore to be understood that within the scope of the appended claims, the invention(s) may be practiced otherwise than as specifically described herein. Thus, the scope of the invention(s) is as described herein and as set forth in the appended claims, and as indicated by the drawing and by the foregoing description, is intended to include variations from the embodiments provided which are nevertheless described by the broad interpretation and range properly afforded to the plain meaning of the language of the claims set forth below.

What is claimed is:

1. A replaceable heat transfer module for use in providing thermal contact between a first heat transfer fluid and a working product, said first heat transfer fluid and said working product having differing temperatures, said replaceable heat transfer module comprising:

(a) an inlet floodbox, said inlet floodbox comprising at least one inlet for said first heat transfer fluid, and a plurality of fluid distribution passageways for discharge of said first heat transfer fluid;

(b) an outlet manifold, said outlet manifold comprising a plurality of fluid collection passageways for collection of said first heat transfer fluid, and at least one outlet for said first heat transfer fluid;

(c) extending in a fluid tight relationship between said plurality of fluid distribution passageways and said plurality of fluid collection passageways, a thin, elongate evaporator envelope, said evaporator envelope comprising a lower flexible planar sheet and an upper flexible planar sheet, said upper flexible planar sheet and said lower flexible planar sheets each having inner surfaces located in a back-to-back spaced apart relationship, said evaporator envelope having (i) an upper end wherein said lower and said upper flexible planar sheets are fluidly sealed to said inlet floodbox, (ii) a lower end wherein said lower and said upper planar sheets are fluidly sealed to said outlet manifold, and (iii) a first edge portion and a second edge portion, at each of which said lower flexible planar sheet and said upper flexible planar sheet are fluidly sealed together.

2. The apparatus as set forth in claim 1, wherein said lower and said upper flexible planar sheets each comprise an infrared permeable material.

3. The apparatus as set forth in claim 2, wherein said infrared permeable material is substantially infrared transparent.

4. The apparatus as set forth in claim 1, or in claim 3, wherein said upper flexible planar sheet comprises a thin sheet of polyester film.

5. The apparatus as set forth in claim 1, wherein said lower flexible planar sheet comprises a thin sheet of polyester film.

6. The apparatus as set forth in claim 1, wherein at said first edge portion a first joint is provided between said lower flexible planar sheet and said upper flexible planar sheet, and wherein at said second edge portion a second joint is provided between said lower flexible planar sheet and said upper flexible planar sheet, and wherein said first joint and said second joint are fluidly sealed by a pressure sensitive adhesive between said lower and said upper flexible planar sheets.

7. The apparatus as set forth in claim 1, further comprising a tail collection sheet, said tail collection sheet extending past said outlet manifold for a preselected distance in order to carry said working product to a working product collection pan.

8. The apparatus as set forth in claim 7, wherein said tail collection sheet comprises an integral extension of said upper flexible planar sheet, and wherein said upper flexible planar sheet comprises a top end portion and a bottom end portion, wherein said bottom end portion comprises an upstream edge fluidly sealed at a third joint to said top end portion, and wherein said bottom end portion comprises a downstream edge fluidly sealed to said outlet manifold.

9. The apparatus as set forth in claim 8, wherein said third joint between said bottom end portion and said top end portion is spaced upstream a preselected distance from said outlet manifold.

10. The apparatus as set forth in claim 9, wherein said preselected distance is from about 20 centimeters to about one meter.

11. The apparatus as set forth in claim 1, wherein said fluid distribution passageways in said inlet floodbox are arranged to distribute said first heat transfer fluid substantially uniformly along upper end of said evaporator envelope so that said first heat transfer fluid descends in a continuous film between said inner surfaces of said lower and said upper flexible planar sheets.

12. The apparatus as set forth in claim 1, wherein said at least one inlet to said inlet floodbox is configured for upflow of said first heat transfer fluid from said at least one inlet to said fluid distribution passageways.

13. The apparatus as set forth in claim 12, wherein said inlet floodbox comprises an upper headspace, said upper headspace configured to contain a trapped air bubble, so as to provide for a free weir action of water exiting through said liquid distribution passageways.

14. The apparatus as set forth in claim 1, wherein said lower and said upper flexible planar sheets have a thickness on the order of millimeters or a fraction thereof, and wherein the space in said evaporator envelope between said inner surface of said lower flexible planar member and said inner surface of said upper flexible planar member is of a size on the order of centimeters, and wherein said evaporator envelope has a length between said inlet floodbox and said outlet manifold on the order of meters, or a fraction thereof.

15. The apparatus as set forth in claim 1, wherein said evaporator envelope comprises a first marginal width extending transversely beyond a first end of said inlet floodbox and a first end of said outlet manifold.

16. The apparatus as set forth in claim 1, or in claim 15, wherein said evaporator envelope comprises a second marginal width extending transversely beyond a second end of said inlet floodbox and a second end of said outlet manifold.

17. The apparatus as set forth in claim 15, wherein said evaporator envelope comprises a base running substantially between said inlet floodbox and said outlet manifold, and wherein said first marginal width is sized and shaped for sloping outwardly and upwardly from said base.

18. The apparatus as set forth in claim 16, wherein said evaporator envelope comprises a base running substantially between said inlet floodbox and said outlet manifold, and wherein said second marginal width is sized and shaped for sloping outwardly and upwardly from said base.

19. The apparatus as set forth in claim 1, wherein said inlet floodbox comprises an inlet upper clamp, and wherein said inlet upper clamp secures said upper flexible planar sheet to said inlet floodbox.

20. The apparatus as set forth in claim 1, or in claim 19, wherein said inlet floodbox comprises an inlet lower clamp, and wherein said inlet lower clamp secures said lower flexible planar sheet to said inlet floodbox.

21. The apparatus as set forth in claim 1, wherein said outlet manifold comprises an outlet lower clamp, and wherein said outlet lower clamp secures said lower flexible planar sheet to said outlet manifold.

22. The apparatus as set forth in claim 8, wherein said outlet manifold comprises an outlet upper clamp, and wherein said outlet upper clamp secures said downstream edge of said bottom end portion of said upper flexible planar sheet to said outlet manifold.

23. The apparatus as set forth in claim 20, wherein said inlet lower clamp is secured to said inlet floodbox with a plurality of upwardly protruding fasteners, and wherein said upwardly protruding fasteners support said upper flexible planar sheet a spaced apart distance from said plurality of fluid distribution passageways, so that said first heat transfer fluid can freely flow from said fluid distribution passageways to said evaporator envelope.

24. The apparatus as set forth in claim 21, wherein said outlet lower clamp is secured to said outward manifold with a plurality of upwardly protruding fasteners, and wherein said upwardly protruding fasteners support said upper flexible planar sheet a spaced apart distance from said plurality of fluid collection passageways, so that said first heat transfer fluid can freely flow from said evaporator envelope and into said fluid collection passageways.

25. The apparatus as set forth in claim 1, wherein two or more inlets are provided to said inlet floodbox.

26. The apparatus as set forth in claim 1 or in claim 25, wherein each one of at least one inlet further comprises a quick connect sanitary fitting.

27. The apparatus as set forth in claim 1, wherein two or more outlets are provided to said outlet manifold.

28. The apparatus as set forth in claim 1 or in claim 27, wherein each one of at least one outlet further comprises a quick connect sanitary fitting.

29. The apparatus as set forth in claim 1, wherein said inlet floodbox comprises an inlet face cover portion, and wherein said liquid distribution passageways are provided in said inlet face cover portion.

30. The apparatus as set forth in claim 29, wherein said inlet face cover portion has an upper end and a lower end, flow-wise, and wherein said liquid distribution passageways are provided closer to said lower end than to said upper end of said inlet face cover portion.

31. The apparatus as set forth in claim 1, wherein said outlet manifold comprises an outlet face cover portion, and wherein said liquid collection passageways are provided in said outlet face cover portion.

32. The apparatus as set forth in claim 31, wherein said outlet face cover portion has an upstream end and a downstream end, and wherein said liquid collection passageways are provided in said inlet face cover portion closer to said upstream end than to said downstream end.

33. The apparatus as set forth in claim 29, wherein said inlet floodbox further comprises internal baffles, said internal baffles oriented to break the force of said first heat transfer fluid entering through each one of said at least one inlet, so as to evenly distribute said first heat transfer fluid.

34. The apparatus as set forth in claim 29, wherein two inlets are provided in said inlet floodbox, and wherein said inlet floodbox includes, transversely, first and second ends, and wherein said inlets are spaced equidistant from said first end and said second ends.

35. The apparatus as set forth in claim 1, wherein said outlet manifold further comprises an elongate trough, said trough having upper edges, and wherein said outlet manifold further comprises at least one fluid outlet passageway adjacent at least one of said upper edges, said at least one fluid outlet passageway adapted for vacuum service, so that vacuum may be applied to remove air from said outlet manifold when said outlet manifold is filled with said first heat transfer fluid.

36. The apparatus as set forth in claim 1, wherein said evaporator envelope, upon filling with said first heat transfer fluid, forms a monocoque structure.

37. The apparatus as set forth in claim 1, wherein said lower and said upper flexible planar sheets are sufficiently flexible and resilient that said replaceable heat transfer module, when not containing said first heat transfer fluid, can be folded or rolled into a compact, shippable package including said evaporator envelope and said inlet floodbox and said outlet manifold.

38. The apparatus as set forth in claim 23, wherein said fasteners comprise bolts having heads.

39. The apparatus as set forth in claim 1, wherein each one of said plurality of fluid distribution passageways and each one of said plurality of fluid collection passageways are configured in a parallelepiped orientation with smooth, rounded corner portions, and wherein the long portion of parallelepiped passageways extends in a side to side orientation with respect to said evaporator envelope.

40. An evaporator, said evaporator comprising:

(a) a structural base;

(b) an adjustably inclinable support tray, said support tray adjustably affixed to said structural base, said adjustably inclinable support tray comprising:

(1) an inlet floodbox support;

(2) an outlet manifold support;

(3) extending substantially between said inlet floodbox support and said outlet manifold support, a generally flat support pan having a length and a width, (c) a replaceable heat transfer module as set forth in claim 1, said replaceable heat transfer module removably affixed to said adjustably inclinable support tray.

41. The apparatus as set forth in claim 40, wherein said apparatus further comprises a retractable hood, said retractable hood comprising:

(1) an air inlet, (2) an air outlet, and (3) extending between said air inlet and said air outlet, a sweep air plenum, said sweep air plenum configured to substantially match the length and width of said support pan, said sweep air plenum retractably affixed to said structural base.

42. The apparatus as set forth in claim 41, wherein said sweep air plenum comprises side portions configured for close fitting mating engagement with said support pan, so that air passing through said sweep plenum is substantially prevented from escaping outward between said sweep air plenum and said support pan.

43. The apparatus as set forth in claim 41, wherein said air inlet and said air outlet are arranged for counter-current flow of air with respect to flow of said first heat transfer fluid from said inlet floodbox to said outlet manifold.

44. The apparatus as set forth in claim 41, wherein said air outlet further comprises a drain outlet, said drain outlet configured to trap for discharge any liquids arriving at or condensing in said air outlet.

45. The apparatus as set forth in claim 41, wherein said adjustably inclinable support tray and said retractable hood are pivotally joined.

46. The apparatus as set forth in claim 45, wherein said support tray and said retractable hood are pivotally joined adjacent said inlet floodbox support.

47. The apparatus as set forth in claim 40, wherein said support tray is adjustable to a selected downwardly sloping angle alpha ($\alpha$), with respect to a horizontal reference plane.

48. The apparatus as set forth in claim 47, wherein said selected downwardly sloping angle alpha ($\alpha$) is between about 30 degrees and about 45 degrees.

49. The apparatus as set forth in claim 47, wherein said selected downwardly sloping angle alpha ($\alpha$) is larger than about 45 degrees.

50. The apparatus as set forth in claim 47, wherein said selected downwardly sloping angle alpha ($\alpha$) is less than about 30 degrees.

51. The apparatus as set forth in claim 45, wherein said support retractable hood is pivotable to a selected upwardly sloping angle beta ($\beta$), with respect to said support tray.

52. The apparatus as set forth in claim 47, further comprising at least one adjustable support tray actuator, and wherein said support tray is adjustably raised and lowered to said preselected angle alpha ($\alpha$) by movement of said at least one support tray actuator.

53. The apparatus as set forth in claim 52, wherein said at least one adjustable support tray actuator comprises a telescopic cylinder.

54. The apparatus as set forth in claim 53, wherein said telescopic cylinder comprises a pneumatic or hydraulic actuator.

55. The apparatus as set forth in claim 45, further comprising at least one retractable hood actuator, and wherein said retractable hood actuator is adjustably raised and lowered to said preselected angle beta ($\beta$), by movement of said at least one retractable hood actuator.

56. The apparatus as set forth in claim 55, wherein said at least one retractable hood actuator comprises a telescopic cylinder.

57. The apparatus as set forth in claim 56, wherein said telescopic cylinder comprises a pneumatic or hydraulic actuator.

58. The apparatus as set forth in claim 40, further comprising, adjacent said inlet floodbox and in close proximity to said upper flexible planar sheet, a working product distributor, said working product distributor configured to distribute a working product on to said upper flexible planar sheet, so that said working product may flow by gravity downward along said upper flexible planar sheet.

59. The apparatus as set forth in claim 58, (a) wherein said apparatus further comprises a working product collection pan, and (b) wherein said replaceable heat transfer apparatus further comprises a tail collection sheet, said tail collection sheet extends past said outlet manifold for a preselected distance;

in order to carry said working product to said working product collection pan.

60. The apparatus as set forth in claim 59, further comprising a product tank, said product tank fluidly connected to receive working product collected in said working product collection pan.

61. The apparatus as set forth in claim 60, further comprising a positive displacement pump, said pump having an inlet configured to receive working product from said product tank, and an outlet configured to discharge working product to said working product distributor.

62. The apparatus as set forth in claim 40, wherein (a) said evaporator envelope comprises, lengthwise, a first marginal width extending transversely beyond a first end of said inlet floodbox and a first end of said outlet manifold;

(b) said evaporator envelope comprises, lengthwise, a second marginal width extending transversely beyond a second end of said inlet floodbox and a second end of said outlet manifold; (c) said support tray further comprises, transversely, upwardly and outwardly extending sidewall portions extending from lateral edges of said support pan, said sidewall portions configured to provide a generally flat trough with sloping sides to carry working product, and wherein said first marginal width is sized and shaped for sloping outwardly and upwardly from said support pan, and said second marginal width is sized and shaped for sloping outwardly and upwardly from said support pan.

63. The apparatus as set forth in claim 40, wherein said support tray comprises a plurality of removable, cleanable tray portions.

64. The apparatus as set forth in claim 55, further comprising, on said structural base, a retractable hood safety catch, said safety catch movable into a hood support position to secure said retractable hood in an open position independently of said actuators.

65. The apparatus as set forth in claim 52, further comprising a support tray lock, said support tray lock movable into a support tray support position to secure said support tray at a selected angle alpha independently of said actuators.

66. The apparatus as set forth in claim 65, wherein said support tray lock comprises (a) a toothed latch, said toothed latch secured to said structural base, and (b) a retractable pin, said retractable pin sized and shaped for movement between (1) a locking position in which said pin rests in said toothed latch to lock said support tray at a first position, and (2) a retracted position, in which said support tray can be moved to another desired angle alpha ($\alpha$).

67. The apparatus as set forth in claim 66, wherein said retractable pin is moved by a hydraulic or pneumatic actuator.

68. The apparatus as set forth in claim 41, wherein said retractable hood further comprises, adjacent said air inlet, one or more sight windows, said sight windows sized and shaped to allow viewing of flow of working product along said evaporator envelope.

69. The apparatus as set forth in claim 1, or in claim 40, wherein said polyester sheet has a thickness of about 3 to 8 mils.

70. A process for evaporation of liquid from a working product, said working product comprising a liquid, or a slurry, or pumpable high viscosity material, or any substance or product material where particulates are included in a liquid, a slurry, or a pumpable high viscosity material, said process comprising:

(a) providing an evaporator apparatus as set forth in claim 40;

(b) providing a retractable hood as set forth in claim 41, and placing said retractable hood in a working position in close proximity to said support tray;

(c) introducing a first heat transfer fluid into said inlet floodbox, and establishing flow of said first heat transfer fluid at a preselected inlet temperature;

(d) distributing said working product on said evaporator envelope, and allowing said working product to flow by gravity to a working product collection pan;

(e) collecting as a vapor in a sweep air stream the solvent removed from said working product, said sweep air stream running countercurrent to the flow of said working product down the face of said evaporator envelope.

71. The process as set forth in claim 70, further comprising the step of adjusting the angle alpha of said support tray to maintain desired throughput of working product and concentration of working product.

72. The process as set forth in claim 70, wherein said working product comprises a food material.

73. The process as set forth in claim 72, wherein said food material comprises a fruit mixture, or a berry mixture, or a juice.

74. The process as set forth in claim 70, wherein said sweep air is conditioned to a desired temperature and humidity level to assist removal of solvent from said working product.

75. The process as set forth in claim 70, wherein said sweep air comprises ambient air.

76. A process for chilling a working product, said working product comprising a liquid, or a slurry, or pumpable high viscosity material, or any substance or product material where particulates are included in a liquid, a slurry, or a pumpable high viscosity material, said process comprising:

(a) providing an apparatus as set forth in claim 40;

(b) providing a retractable hood as set forth in claim 41, and placing said retractable hood in a working position in close proximity to said support tray;

(c) introducing a first heat transfer fluid into said inlet floodbox, and establishing flow of said first heat transfer fluid at a preselected inlet temperature;

(d) distributing said working product on said evaporator envelope, and allowing said working product to flow by gravity to a working product collection pan.

77. The process as set forth in claim 76, wherein said first heat transfer fluid comprises chilled water.

78. The process as set forth in claim 76, wherein said working product comprises a food material.

79. The process as set forth in claim 78, wherein said food material comprises a fruit mixture, or a berry mixture, or a juice.

80. The process as set forth in claim 76, wherein sweep air is provided to said retractable hood, and wherein said sweep air is conditioned to a desired temperature and humidity level to assist in chilling of said working product.

81. The process as set forth in claim 76, wherein said first heat transfer fluid comprises a super-cooled heat transfer fluid, having a freezing point below the freezing point of water, selected from the group comprising (a) brine, including salt brine, (b) glycol-water mixtures, and (c) non-aqueous heat transfer fluids.

82. The process as set forth in claim 75, wherein said first heat transfer fluid is transparent.

83. The apparatus as set forth in claim 21, further comprising an outlet face block, said outlet face block having a downstream length and a machine width, said face further comprising an upstream lip portion, said lip portion sealingly engaged against said lower flexible planar sheet, so as to seal said lower flexible planar sheet against said outlet manifold.

84. The apparatus as set forth in claim 83, wherein said outlet face block comprises a downstream tail having an upper sealing surface, and wherein said upper sealing surface sealingly engages said upper flexible planer sheet so as to seal said upper flexible planar sheet thereto.

85. The apparatus as set forth in claim 84, wherein said outlet face block downstream tail further comprises a lower sealing surface, and wherein said lower sealing surface sealingly engages said upper surface of said cover plate portion of said outlet manifold.

86. The apparatus as set forth in claim 84, wherein said outlet face block is generally triangular cross section save for said upstream lip portion which protrudes in an upstream direction for a preselected sealing width distance.

87. The apparatus as set forth in claim 83, wherein said outlet face block comprises a plurality of outlet orifices, and wherein said outlet orifices comprise a plurality of fluid collection passageways, so that said first heat transfer fluid can freely flow from said evaporator envelope and through said outlet face block.

* * * * *